US008634743B2

(12) United States Patent
Akaike et al.

(10) Patent No.: US 8,634,743 B2
(45) Date of Patent: Jan. 21, 2014

(54) DETACHABLE BODY AND IMAGE FORMING APPARATUS

(75) Inventors: Takashi Akaike, Saitama (JP); Toshio Takiguchi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1054 days.

(21) Appl. No.: 12/570,391

(22) Filed: Sep. 30, 2009

(65) Prior Publication Data

US 2010/0247137 A1 Sep. 30, 2010

(30) Foreign Application Priority Data

Mar. 27, 2009 (JP) ..... P2009-080670
Mar. 27, 2009 (JP) ..... P2009-080671

(51) Int. Cl.
*G03G 15/00* (2006.01)

(52) U.S. Cl.
USPC ..... 399/110; 399/119; 399/120; 399/123; 399/358; 399/360

(58) Field of Classification Search
USPC ..... 399/110, 120, 123, 360
See application file for complete search history.

(56) References Cited

U.S. PATENT DOCUMENTS 4,839,691 A * 6/1989 Tagawa et al. ..... 399/12
4,916,490 A * 4/1990 Tanaka et al. ..... 399/119
5,589,915 A 12/1996 Hashimoto
5,911,096 A * 6/1999 Batori et al. ..... 399/111
5,930,561 A 7/1999 Hosokawa et al. ..... 399/111
6,853,821 B2 * 2/2005 Ishiguro et al. ..... 399/119
6,934,492 B2 * 8/2005 Hiura et al. ..... 399/258
6,978,107 B2 * 12/2005 Nagashima et al. ..... 399/262
7,020,416 B2 * 3/2006 Kato et al. ..... 399/110
7,321,739 B1 * 1/2008 Dawson et al. ..... 399/90
7,711,288 B2 * 5/2010 Saiki et al. ..... 399/120
7,831,190 B2 * 11/2010 Yang ..... 399/360
7,856,198 B2 * 12/2010 Saito et al. ..... 399/262

(Continued)

FOREIGN PATENT DOCUMENTS

JP 04-133085 5/1992
JP 05-341635 12/1993

(Continued)

OTHER PUBLICATIONS

Chinese Office Action dated Dec. 12, 2012 issued by the State Intellectual Property Office of P.R. China in corresponding Chinese Patent Application No. 200910223080.6.

*Primary Examiner* — David Gray
*Assistant Examiner* — Geoffrey Evans
(74) *Attorney, Agent, or Firm* — Sughrue Mion, PLLC

(57) ABSTRACT

In an image forming apparatus defined herein, in case the opening/closing member is rotationally moved from the opened position toward the normal position, when the detachable body main unit is at a restricted position between the attached position and the separated position, the restricting portion is contacted with the restricted portion to be moved between the opening/closing member and the detachable body main unit, so as to restrict a rotational movement of the opening/closing member to the normal position, and, when the detachable body main unit is at the attached position, the restricting portion and the restricted portion that is being rotated are separated from each other to enable the opening/closing member to be rotationally moved to the normal position, and, in case the opening/closing member is moved to the normal position, the restricted portion is housed in a space between the detachable body main unit and the opening/closing member.

11 Claims, 15 Drawing Sheets

(56) References Cited

U.S. PATENT DOCUMENTS

| | | | | |
|---|---|---|---|---|
| 8,019,252 | B2 * | 9/2011 | Funada et al. | 399/110 |
| 8,244,155 | B2 * | 8/2012 | Kouda | 399/119 |
| 8,270,872 | B2 * | 9/2012 | Takiguchi et al. | 399/114 |
| 8,290,396 | B2 * | 10/2012 | Lee et al. | 399/111 |
| 8,315,536 | B2 * | 11/2012 | Fujita | 399/110 |
| 8,385,800 | B2 * | 2/2013 | Masuda et al. | 399/328 |
| 8,401,434 | B2 * | 3/2013 | Akaike | 399/258 |
| 8,437,658 | B2 * | 5/2013 | Honobe et al. | 399/110 |
| 8,463,158 | B2 * | 6/2013 | Okabe | 399/112 |
| 8,472,836 | B2 * | 6/2013 | Nomi | 399/110 |
| 8,483,593 | B2 * | 7/2013 | Okabe et al. | 399/110 |
| 8,488,991 | B2 * | 7/2013 | Sato | 399/110 |
| 2002/0150404 | A1 * | 10/2002 | Matsuzaka et al. | 399/111 |
| 2003/0219264 | A1 * | 11/2003 | Serizawa | 399/35 |
| 2004/0234293 | A1 * | 11/2004 | Karakama et al. | 399/111 |
| 2005/0175382 | A1 * | 8/2005 | Kweon | 399/360 |
| 2007/0196136 | A1 * | 8/2007 | Yamamoto et al. | 399/258 |
| 2008/0124118 | A1 | 5/2008 | Ukai et al. | |
| 2008/0286014 | A1 * | 11/2008 | Saito et al. | 399/263 |
| 2009/0097879 | A1 * | 4/2009 | Nagashima et al. | 399/120 |
| 2010/0119271 | A1 * | 5/2010 | Akaike | 399/358 |
| 2010/0209157 | A1 * | 8/2010 | Sato et al. | 399/343 |
| 2012/0114390 | A1 * | 5/2012 | Ozawa et al. | 399/262 |
| 2013/0183062 | A1 * | 7/2013 | Lee | 399/110 |
| 2013/0195505 | A1 * | 8/2013 | Hashimoto et al. | 399/110 |

FOREIGN PATENT DOCUMENTS

| | | | |
|---|---|---|---|
| JP | 08-016064 | | 1/1996 |
| JP | 10-282863 | | 10/1998 |
| JP | 2000-194203 | | 7/2000 |
| JP | 2000-231312 | | 8/2000 |
| JP | 2000-231322 | | 8/2000 |
| JP | 3244992 | B2 | 10/2001 |
| JP | 2004-205797 | | 7/2004 |
| JP | 2005-070406 | | 3/2005 |
| JP | 2005-77513 | | 3/2005 |
| JP | 2008134479 | A | 6/2008 |
| JP | 2008-175985 | | 7/2008 |
| JP | 2008-292804 | | 12/2008 |
| JP | 2009053563 | A | 3/2009 |

* cited by examiner

WH4
U2a
VC
VD
X
Y
Z
(−X)
(−Y)
(−Z)

16
18
19f
19
48
42
47
19b
22
U2b
26
32
43
44a
49
23
31
46
33a
44

16
18
19a
19
48
47a
22
U2b
26
42
42b
43
44a
44
32
23
31
46a

Z
(-X)
(-Y)
(-Z)
Y
X
16
18
19
48
47a
22
U2b
26
42
44
24
43
44a
32
23
24
31
46a 16
18
19
48
26
42
47a
44
43
44a
32
31
46a
U2b

DETACHABLE BODY AND IMAGE FORMING APPARATUS

CROSS-REFERENCE TO RELATED APPLICATIONS

This application is based on and claims priority under 35 USC 119 from Japanese Patent Application No. 2009-080671 filed on Mar. 27, 2009, and Japanese Patent Application No. 2009-080670 filed on Mar. 27, 2009.

BACKGROUND

1. Technical Field

The present invention relates to a detachable body and an image forming apparatus.

2. Related Art

In an image forming apparatus, various members are often configured as a detachable body while being unitized or detachable bodies while remaining as single members, so as to be attachable and detachable to and from the main unit of the image forming apparatus. Some image forming apparatuses of the electrophotographic type include a developer recovery container for recovering a developer which is not used in recording on a medium to remain and the like. There is a case where a developer recovery container is detachably attached to a main unit of an image forming apparatus in order that, when the container is filled with the recovered developer, the container can be replaced with a new one.

SUMMARY

According to an aspect of the invention, there is provided an image forming apparatus including: an opening which is formed in an outer face of an image forming apparatus main unit; an attached/detached portion which is formed inside the image forming apparatus main unit, and which is connected to the opening; an opening/closing member which is supported by a support shaft, which is supported to be rotatable between an opened position where the opening is exposed to an outside, and a normal position where the opening is closed from the outside, and in which a restricted portion is disposed in a face on a side of the image forming apparatus main unit; a detachable body main unit which is attached and detached by being inserted and extracted between an attached position where the unit is attached to the attached/detached portion, and a separated position where the unit is drawn out from the attached/detached portion to an outside of the image forming apparatus main unit; and a restricting portion which is disposed downstream in a detachable body main unit drawing direction that is directed from the attached position of the detachable body main unit to the separated position, and which is contactable with the restricted portion, wherein, in a case where the opening/closing member is rotationally moved from the opened position toward the normal position, when the detachable body main unit is at a restricted position which is between the attached position and the separated position, the restricting portion is contacted with the restricted portion to be moved between the opening/closing member and the detachable body main unit, thereby restricting a rotational movement of the opening/closing member to the normal position, and, when the detachable body main unit is at the attached position, the restricting portion and the restricted portion which is being rotated are separated from each other to enable the opening/closing member to be rotationally moved to the normal position, and, in a case where the opening/closing member is moved to the normal position, the restricted portion is housed in a space between the detachable body main unit and the opening/closing member.

BRIEF DESCRIPTION OF THE DRAWINGS

Exemplary embodiments of the present invention will be described in detail based on the following figures, wherein:

FIG. 5A is a diagram of a state where a waste toner box is attached to the box attaching/detaching portion, FIG. 5B is a diagram of a case where the waste toner box is attached or detached to or from the box attaching/detaching portion, FIG. 5C is a sectional view taken along line VC-VC in FIG. 5B, and FIG. 5D is a sectional view taken along line VD-VD in FIG. 5B;

FIG. 9A is a perspective view, and FIG. 9B is a view as seen in the direction of arrow IXB in FIG. 9A;

FIG. 10A is a view of a case where the front cover is held to an opened position, FIG. 10B is a view of a case where the front cover is held to a normal position, FIG. 10C is a view corresponding to FIG. 10A and showing a state where a box handle is moved to a drawn position, and FIG. 10D is a view of a case where the waste toner box is attached or detached, and showing a state where the latch is held to a separation projected position;

FIG. 11A is a view of a case where the front cover is held to the opened position, FIG. 11B is a view of a case where the front cover is held to the normal position, and FIG. 11C is a view corresponding to FIG. 11A and showing a state where the box handle is moved to the drawn position;

FIG. 12A is an enlarged view of main portions of FIG. 10A, and FIG. 12B is an enlarged view of main portions of FIG. 10C;

FIG. 13A is a view of a case where the front cover is held to the opened position, FIG. 13B is a view subsequent to FIG. 13A, and showing a state where the front cover is moved from the opened position and first ribs are contacted with a rib housing recess, FIG. 13C is a view subsequent to FIG. 13B, and FIG. 13D is a view subsequent to FIG. 13C, and showing a state where the front cover is restricted by the box handle;

FIG. 14A is a view of a case where the front cover is held to the opened position, FIG. 14B is a view subsequent to FIG. 14A, and showing a state where the front cover is moved from the opened position and second ribs are contacted with the rib housing recess, FIG. 14C is a view subsequent to FIG. 14B, and FIG. 14D is a view subsequent to FIG. 14C, and showing a state where the front cover is restricted by the box handle; FIG. 15A is a view of a case where the front cover is held to the opened position, FIG. 15B is a view subsequent to FIG. 15A, and showing a state where the front cover is moved from the opened position and guide edge portions of the first ribs are contacted with the box handle, FIG. 15C is a view subsequent to FIG. 15B, and showing a state where the second ribs are contacted with the rib housing recess, FIG. 15D is a view subsequent to FIG. 15C, and FIG. 15E is a view subsequent to FIG. 15D, and showing a state where the front cover is restricted by the box handle.

DESCRIPTION OF REFERENCE NUMERALS AND SIGNS

Figure 1:
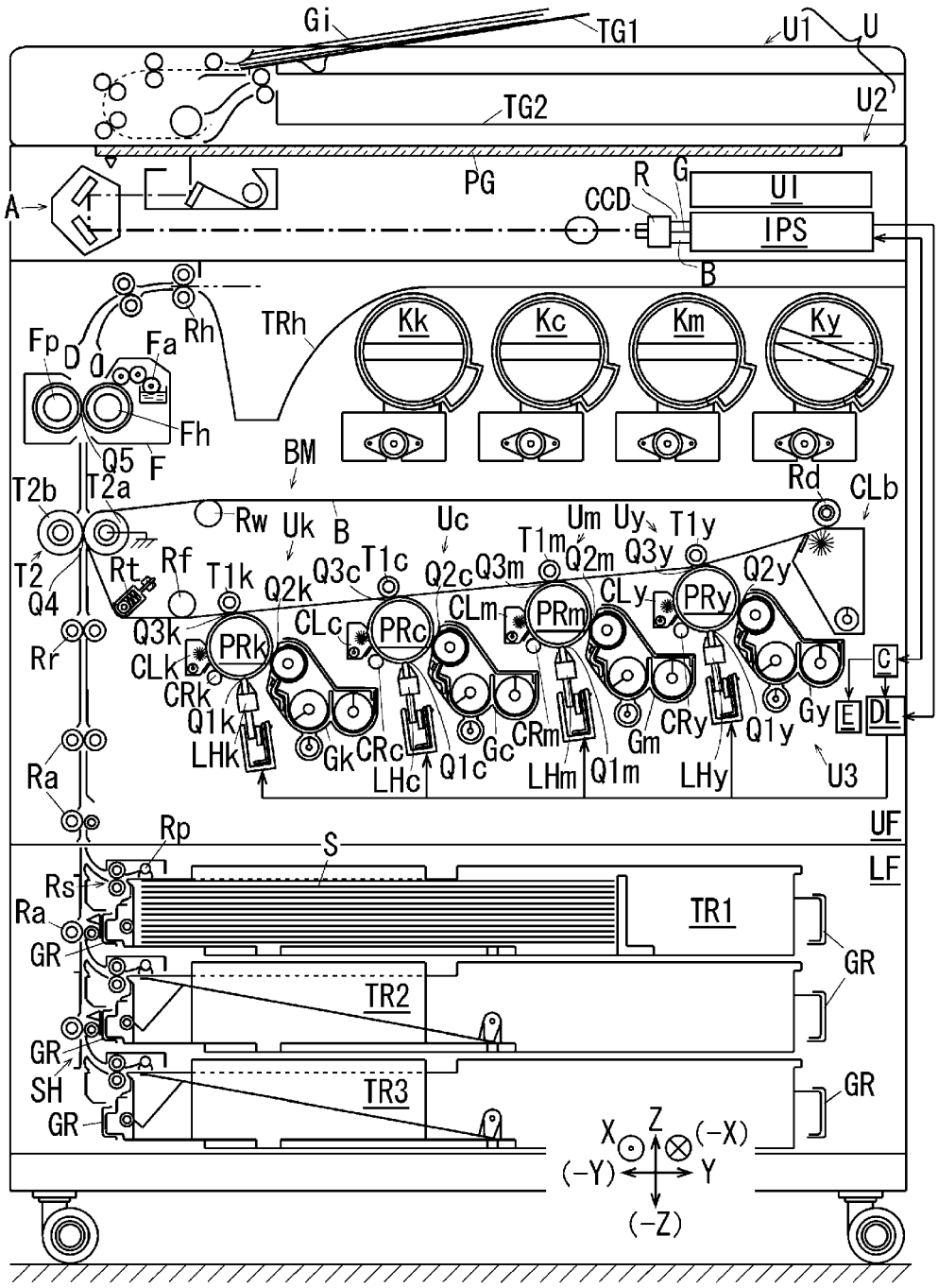
FIG. 1 is a diagram of the whole of an image forming apparatus of Exemplary embodiment 1 of the invention.

11 . . . outer face,
11*a* . . . opening,
22*a* . . . opening/closing member support shaft,
23 . . . restricted portion, first restricted portion,
23*b* . . . guiding portion,
24 . . . restricted portion, second restricted portion,
31 . . . detachable body,
32 . . . detachable body main unit,
33*a* . . . detachable body main unit downstream end face,
44 . . . gripping portion,
49*a* . . . restricting portion,
51 . . . restricted portion housing space,
S . . . medium,
U . . . image forming apparatus,
U2 . . . image forming apparatus main unit,
U2*a* . . . attached/detached portion,
U2*b* . . . opening/closing member,
U3 . . . image recording apparatus.
13+14 . . . pushing member,
14 . . . pushing urging member,
19 . . . locking member,
21 . . . locking urging member,
42 . . . engaging portion,
42*a* . . . locking member contacting portion,
42*b* . . . locking member housing portion,
42*d* . . . pushing member contacting portion,
48*a* . . . cancelling portion,

DETAILED DESCRIPTION

Next, examples which are specific examples (hereinafter, referred to as examples) of an exemplary embodiment of the invention will be described with reference to the drawings. However, the invention is not restricted to the following examples.

In order to facilitate the understanding of the following description, the front and rear directions in the drawings are indicated as X-axis directions, the right and left directions are indicated as Y-axis directions, and the upper and lower directions are indicated as Z-axis directions. The directions or sides indicated by the arrows X, −X, Y, −Y, Z, and −Z are the front, rear, right, left, upper, and lower directions, or the front, rear, right, left, upper, and lower sides, respectively.

In the figures, the symbol in which "●" is written in "○" indicates the arrow which is directed from the rear of the sheet to the front, and that in which "×" is written in "○" indicates the arrow which is directed from the front of the sheet to the rear.

In the following description with reference to the drawings, illustrations of members other than those which are necessary in description are suitably omitted for the sake of easy understanding.

Exemplary Embodiment 1

FIG. 1 is a diagram of the whole of an image forming apparatus of Exemplary embodiment 1 of the invention.

Referring to FIG. 1, the image forming apparatus U includes: an automatic original conveying device U1; and an image forming apparatus main unit U2 which supports the device, and which has a transparent original reading surface PG in the upper end.

The automatic original conveying device U1 has: an original feeding portion TG1 in which a plurality of originals Gi to be copied are stackingly housed; and an original discharging portion TG2 to which the original Gi that has been fed from the original feeding portion TG1, and that is conveyed while being passed through an original reading position on the original reading surface PG is discharged.

The image forming apparatus main unit U2 has an operating portion UI on which the user inputs an operation command signal such as starting of an image forming operation, an exposure optical system A, etc.

Reflected light from an original which is conveyed on the original reading surface PG in the automatic original conveying device U1, or that which is manually placed on the original reading surface PG is converted to electric signals of red R, green G, and blue F by a solid-state imaging device CCD through the exposure optical system A.

An image information converting portion IPS converts the RGB electric signals supplied from the solid-state imaging device CCD to image information of black K, yellow Y, magenta M, and cyan C, temporarily stores the image information, and outputs the image information at a predetermined timing as image information for forming latent images, to a latent-image forming device driving circuit DL.

In the case where the original image is a so-called monochromatic image, only image information of black K is supplied to the latent-image forming device driving circuit DL.

The latent-image forming device driving circuit DL has driving circuits (not shown) for Y, M, C, and K, and, at a predetermined timing, outputs signals corresponding to the supplied image information, to latent-image forming devices LHy, LHm, LHc, LHk which are disposed for the respective colors.

Figure 2:
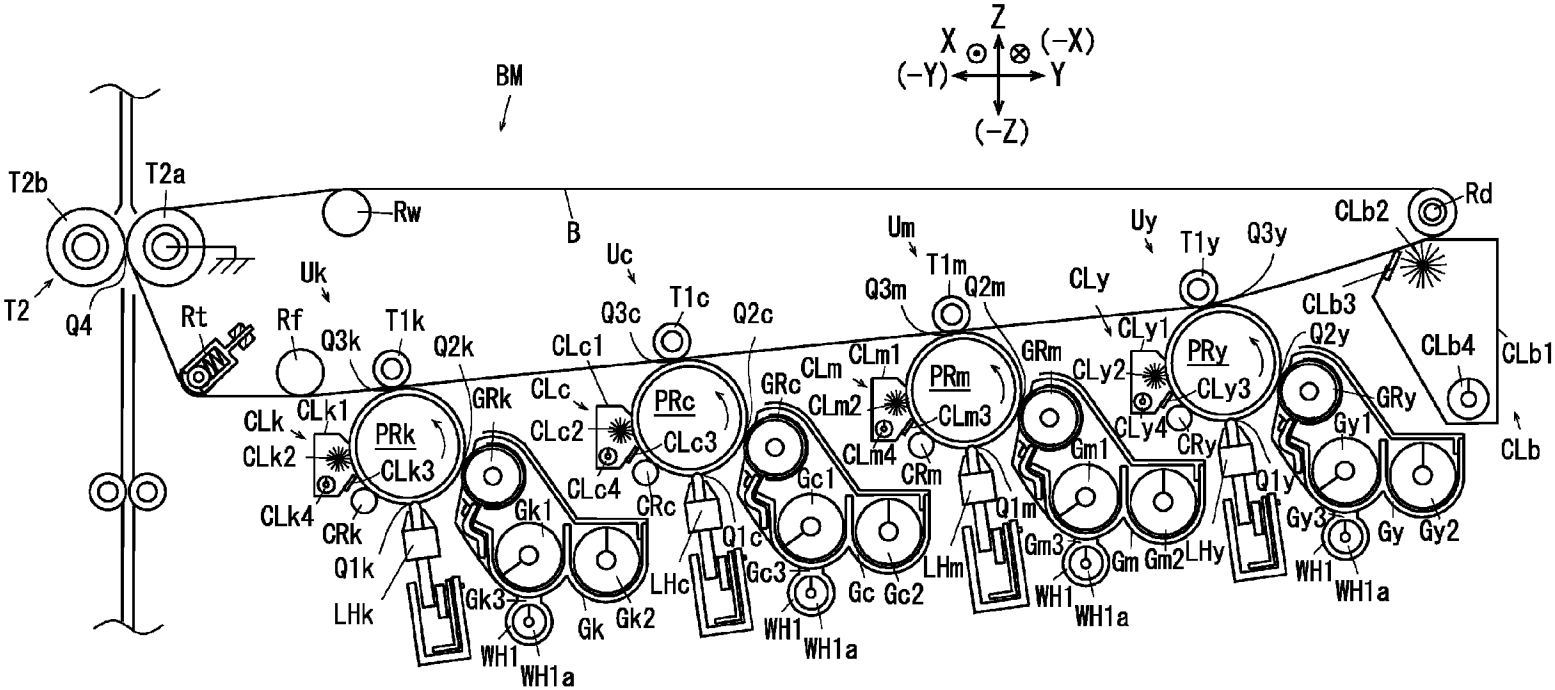
FIG. 2 is an enlarged diagram of the image forming apparatus of Exemplary embodiment 1.

FIG. 2 is an enlarged diagram of the image forming apparatus of Exemplary embodiment 1.

Referring to FIGS. 1 and 2, visible-image forming devices Uy, Um, Uc, Uk which are arranged in a middle portion in the gravitational direction of the image forming apparatus U form visible color images of Y, M, C, and K, respectively.

Latent-image writing light beams of Y, M, C, and K emitted from latent-image writing light sources of the latent-image forming devices LHy to LHk are incident on rotating image carriers PRy, PRm, PRc, PRk, respectively. In Exemplary embodiment 1, the latent-image forming devices LHy to LHk are configured by so-called LED arrays, respectively.

The visible-image forming device Uy for yellow has the rotating image carrier PRy, a charging device CRy, the latent-image forming device LHy, a developing device Gy, a transferring device T1*y*, and an image carrier cleaner CLy which is an example of an image carrier cleaning device. In Exemplary embodiment 1, the image carrier PRy, the charging device CRy, and the image carrier cleaner CLy are configured as an image carrier unit which is integrally attachable and detachable to and from the image forming apparatus main unit U2.

The visible-image forming devices Um, Uc, Uk are configured in the same manner as the visible-image forming device Uy for Y.

Referring to FIGS. 1 and 2, the image carriers PRy, PRm, PRc, PRk are charged by the respective charging devices CRy, CRm, CRc, CRk, and, at image writing positions Q1*y*, Q1*m*, Q1*c*, Q1*k*, electrostatic latent images are formed on the surfaces of the image carriers by the latent-image writing light beams. In developing regions Q2*y*, Q2*m*, Q2*c*, Q2*k*, the electrostatic latent images on the surfaces of the image carriers PRy, PRm, PRc, PRk are developed to toner images which are an example of a visible image, by developers held by developing rolls GRy, GRm, GRc, GRk which are an example of a developer carrier of the developing devices Gy, Gm, Gc, Gk.

The developed toner images are conveyed to primary transferring regions Q3*y*, Q3*m*, Q3*c*, Q3*k* which are contacted with an intermediate transfer belt B that is an example of an intermediate transferring member. A primary transfer voltage the polarity of which is opposite to the charge polarity of the toner is applied from a power source circuit E controlled by a controlling device C, at a predetermined timing to the primary transferring devices T1*y*, T1*m*, T1*c*, T1*k* which are placed in the primary transferring regions Q3*y*, Q3*m*, Q3*c*, Q3*k* and in the rear face side of the intermediate transfer belt B.

The toner images on the image carriers PRy to PRk are primary transferred to the intermediate transfer belt B by the primary transferring devices T1*y*, T1*m*, T1*c*, T1*k*. After the primary transfer, residual and adhering substances on the surfaces of the image carriers PRy, PRm, PRc, PRk are removed by the image carrier cleaners CLy, CLm, CLc, CLk. The surfaces of the image carriers PRy, PRm, PRc, PRk which are cleaned are again charged by the charging devices CRy, CRm, CRc, CRk.

Above the image carriers PRy to PRk, a belt module BM which is vertically movable, which is forward drawable, and which is an example of an intermediate transferring device is placed. The belt module BM has: the intermediate transfer belt B; a belt driving roll Rd which is an example of an intermediate transferring member driving member; a tension roll Rt which is an example of an intermediate transferring member stretching member; a walking roll Rw which is an example of a meandering preventing member; an idler roll Rf which is an example of a driven member; a backup roll T2*a* which is an example of a secondary transferring region opposing member; and the primary transferring devices T1*y*, T1*m*, T1*c*, T1*k*. The intermediate transfer belt B is rotatably supported by a belt supporting roll group Rd+Rt+Rw+Rf+T2*a* which is configured by the rolls Rd, Rt, Rw, Rf, T2*a*, and which is an example of an intermediate transferring member supporting member.

A secondary transferring roll T2*b* which is an example of a secondary transferring member is placed while being opposed to the surface of the intermediate transfer belt B that is contacted with the backup roll T2*a*. The rolls T2*a*, T2*b* constitute a secondary transferring device T2 which is an example of a final transferring device. A secondary transferring region Q4 is formed by a region where the secondary transferring roll T2*b* and the intermediate transfer belt B are opposed to each other.

A monochromatic or superimposed multi-color images which are transferred onto the intermediate transfer belt B in the primary transferring regions Q3*y*, Q3*m*, Q3*c*, Q3*k* by the primary transferring devices T1*y*, T1*m*, T1*c*, T1*k* are conveyed to the secondary transferring region Q4.

Referring to FIG. 1, three pairs of right and left guide rails GR which are an example of a guiding member are disposed below the visible-image forming devices Uy to Uk. Sheet feed trays TR1 to TR3 which are an example of a sheet feeding container are supported by the guide rails GR so as to be advanceable and retractable in the front and rear directions. A recording sheet S which is housed in one of the sheet feed trays TR1 to TR3, and which is an example of a medium is picked up by a pickup roll Rp which is an example of a medium picking up member, and separated one by one by separating rolls Rs which are an example of a medium separating member. Then, the recording sheet S is conveyed along a sheet conveying path SH which is an example of a medium conveying path, by a plurality of conveying rolls Ra which are an example of a medium conveying member, and then sent to a registration roll Rr which is placed upstream from the secondary transferring region Q4 in the sheet conveying direction, and which is an example of a transferring region conveying timing adjusting member. A sheet conveying device SH+Ra+Rr is configured by the sheet conveying path SH, the conveying rolls Ra, the registration roll Rr, and the like.

In synchronization with the conveyance of the toner images formed on the intermediate transfer belt B to the secondary transferring region Q4, the registration roll Rr conveys the recording sheet S to the secondary transferring region Q4. When the recording sheet S is passed through the secondary transferring region Q4, the backup roll T2*a* is grounded, and a secondary transfer voltage the polarity of which is opposite to the charge polarity of the toners is applied from the power source circuit E controlled by the controlling device C is applied to the secondary transferring roll T2*b*. At this time, the toner images on the intermediate transfer belt B are transferred to the recording sheet S by the secondary transferring device T2.

After the secondary transfer, the intermediate transfer belt B is cleaned by a belt cleaner CLb which is an example of an intermediate transferring member cleaning device.

The recording sheet S onto which the toner images are secondary transferred is conveyed to a fixing region Q5 which is a pressure-contact region between a heating roll Fh that is an example of a heating fixing member of the fixing device F, and a pressurizing roll Fp that is an example of a pressurizing fixing member, and, when passed through the fixing region, subjected to thermal fixation. The recording sheet S which has undergone the thermal fixation is discharged to a sheet discharge tray TRh which is an example of a medium discharging portion, by a discharging roll Rh which is an example of a medium discharging member.

A release agent which improves the property of releasing of the recording sheet S from the heating roll is applied to the surface of the heating roll Fh by a release-agent applying device Fa.

An image recording apparatus U3 in Exemplary embodiment 1 is configured by the visible-image forming devices Uy to Uk, the transferring device T1+T2+B, and the fixing device F.

Above the belt module BM, developer cartridges Ky, Km, Kc, Kk which respectively houses developers of yellow Y, magenta M, cyan C, and black K, and which are examples of developer replenishment containers. In accordance with the consumptions of the developers in the developing devices Gy, Gm, Gc, Gk, the developers housed in the developer cartridges Ky, Km, Kc, Kk are replenished to the developing devices Gy, Gm, Gc, Gk through developer replenishing paths which will be described later. In Exemplary embodiment 1, each of the developers is configured by a two-component developer containing a magnetic carrier, and a toner to which an external additive is added.

Referring to FIG. 1, the image forming apparatus U has an upper frame UF and a lower frame LF. The visible-image forming devices Uy to Uk, and members which are placed above the visible-image forming devices Uy to Uk, such as the belt module BM are supported by the upper frame UF.

On the other hand, the guide rails GR which support the sheet feed trays TR1 to TR3, and the sheet feeding members which perform sheet feeding from the sheet feed trays TR1 to TR3, such as the pickup roll Rp, the separating rolls Rs, and the sheet conveying rolls Ra are supported by the lower frame LF.

(Description of Toner Dispenser)

Figure 3:
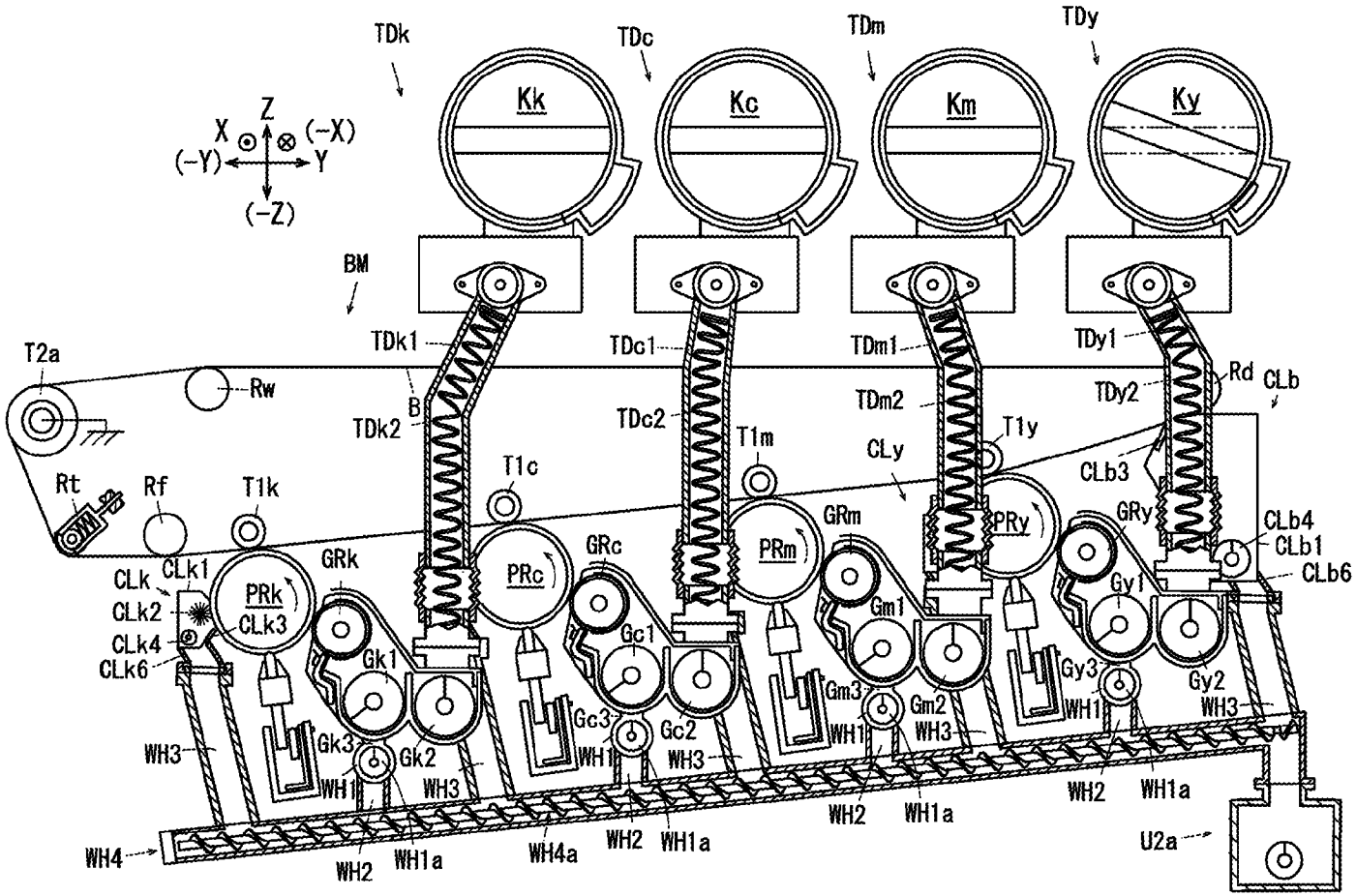
FIG. 3 is a diagram of toner dispensers and a recovered developer conveying device in Exemplary embodiment 1.

FIG. 3 is a diagram of toner dispensers and a recovered developer conveying device in Exemplary embodiment 1.

In FIG. 3, for the sake of easy understanding, illustrations of members such as the charging devices CRy to CRk are suitably omitted.

The toner cartridges Ky to Kk that are an example of a developer replenishment container in which a replenishment developer is housed are supported attachably, detachably, and replaceably by toner dispensers TDy, TDm, TDc, TDk that are an example of a developer replenishing device. The toner dispensers TDy to TDk have developer replenishing paths TDy1 to TDk1 which are extended from the toner cartridges Ky to Kk to the developing devices Gy to Gk. Inside the developer replenishing paths TDy1 to TDk1, developer replenishing members TDy2, TDm2, TDc2, TDk2 which are rotated to convey a developer are supported.

The developer replenishing paths TDy1 to TDk1 are connected so that the developers are flown into the front sides of second augers Gy2, Gm2, Gc2, Gk2 which are an example of a second stirring member, in first augers Gy1, Gm1, Gc1, Gk1 which are disposed in adjacent to the developing rolls GRy to GRk, and which are an example of a first stirring member, and the second augers Gy2 to Gk2 which are disposed on the right sides of the first augers Gy1 to Gk1.

In the developing devices Gy to Gk, deteriorated developer discharging ports Gy3, Gm3, Gc3, Gk3 from which deteriorated developers in the developing devices are discharged are formed so that the deteriorated developers are discharged from the front sides of the first augers Gy1 to Gk1.

The developing devices Gy to Gk in Exemplary embodiment 1 discharge the developers containing deteriorated carriers from the deteriorated developer discharging ports Gy3 to Gk3 while replenishing two-component developers containing highly-concentrated toners and carriers from the toner dispensers TDy to TDk, whereby the inside carriers are gradually replaced.

(Description of Image Carrier Cleaner and Belt Cleaner)

Figure 4:
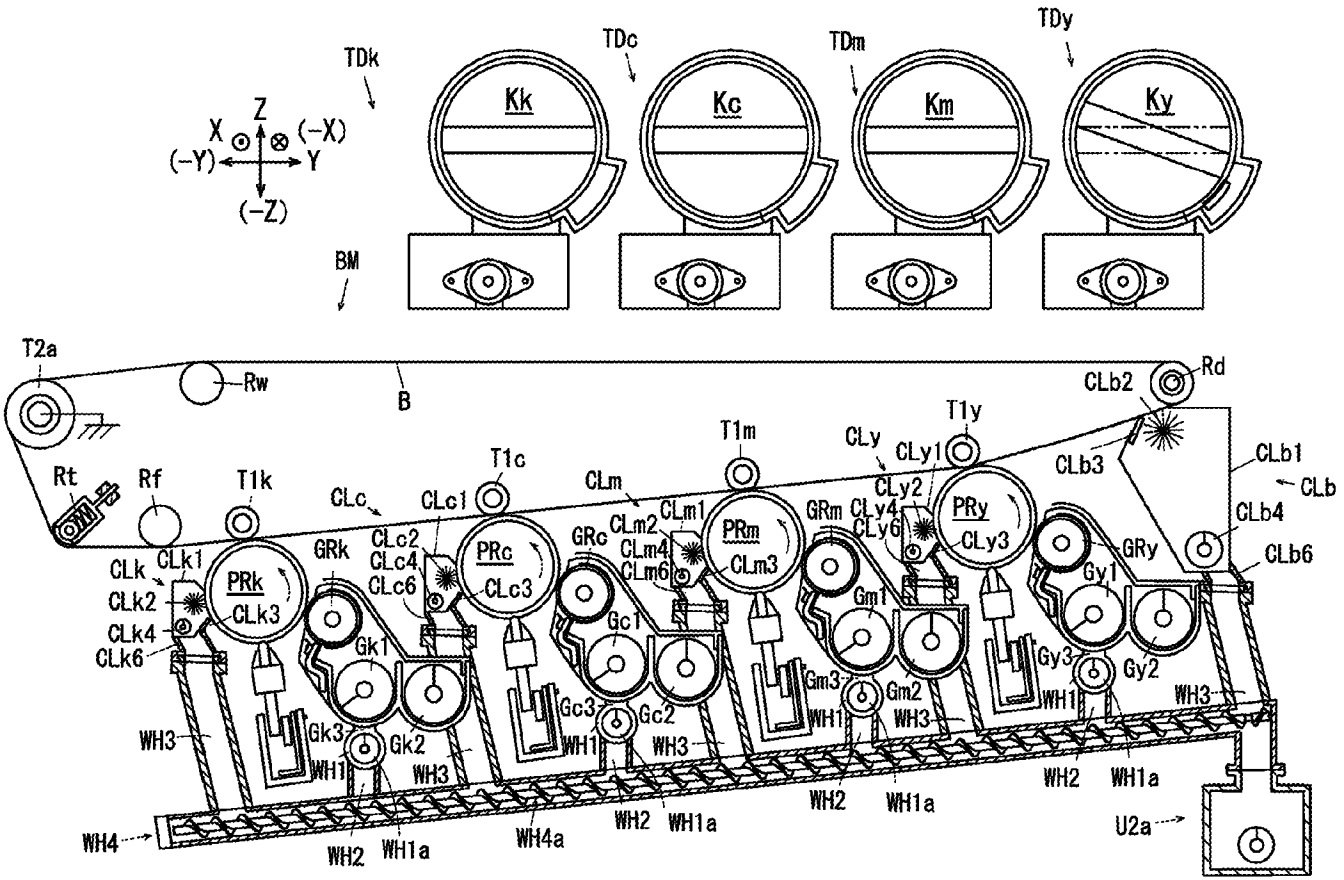
FIG. 4 is a diagram which corresponds to FIG. 3, and in which illustration of developer replenishing paths and developer replenishing members is omitted.

FIG. 4 is a diagram which corresponds to FIG. 3, and in which illustration of the developer replenishing paths and the developer replenishing members is omitted.

Referring to FIGS. 2 to 4, the image carrier cleaner CLk for K has: a cleaning container CLk1; a cleaning brush CLk2 and cleaning blade CLk3 which are contacted with the image carrier PRk to remove residuals adhering to the surface such as residual developers and paper dusts, i.e., so-called waste toner, and which are examples of a removing member; and a waste toner conveying member CLk4 which rearward conveys the removed waste toner in the cleaning container CLk1, and which is an example of a residual conveying member. A waste toner discharging path CLk6 which is an example of a residual discharging path is formed in the rear end of the cleaning container CLk1.

The image carrier cleaners CLy to CLc for the other colors Y, M, and C are configured in the same manner as the image carrier cleaner CLk for K. Referring to FIGS. 2 to 4, in the same manner as the image carrier cleaners CLy to CLk, also the belt cleaner CLb has a cleaning container CLb1, a cleaning brush CLb2, a cleaning blade CLb3, a waste toner conveying member CLb4, and a waste toner discharging path CLb6.

Referring to FIG. 2, connection conveying paths WH1 which are extended from the front side to the rear side, and in which the front end is connected to the deteriorated developer discharging ports Gy3 to Gk3 are supported by the lower faces of the developing devices Gy to Gk. Developer carrying members WH1*a* are rotatably supported in the connection conveying paths WH1, and convey to the rear side the waste toner discharged from the deteriorated developer discharging ports Gy3 to Gk3.

Referring to FIG. 4, drop paths WH2 which are downward extended are connected to the rear ends of the connection conveying paths WH1. Drop paths WH3 which are downward extended are connected to the residual discharging paths CLy6 to CLk6, CLb6. A waste toner discharging path WH4 which is inclinedly extended from the lower left side to the upper right side, and which is an example of a recovered developer conveying path is connected to the lower ends of the drop paths WH2, WH3. The upper right end of the waste toner discharging path WH4 is extended to a box attaching/detaching portion U2*a* which is formed in the image forming apparatus main unit U2, and which is an example of an attached/detached portion.

A developer conveying member WH4*a* is rotatably supported in the waste toner discharging path WH4. The developer conveying member WH4*a* conveys waste toner which drops through the drop paths WH2, WH3 to enter the waste toner discharging path WH4, toward the box attaching/detaching portion U2*a*.

(Description of Box Attaching/Detaching Portion)

Figures 5A, 5B, 5C, 5D:
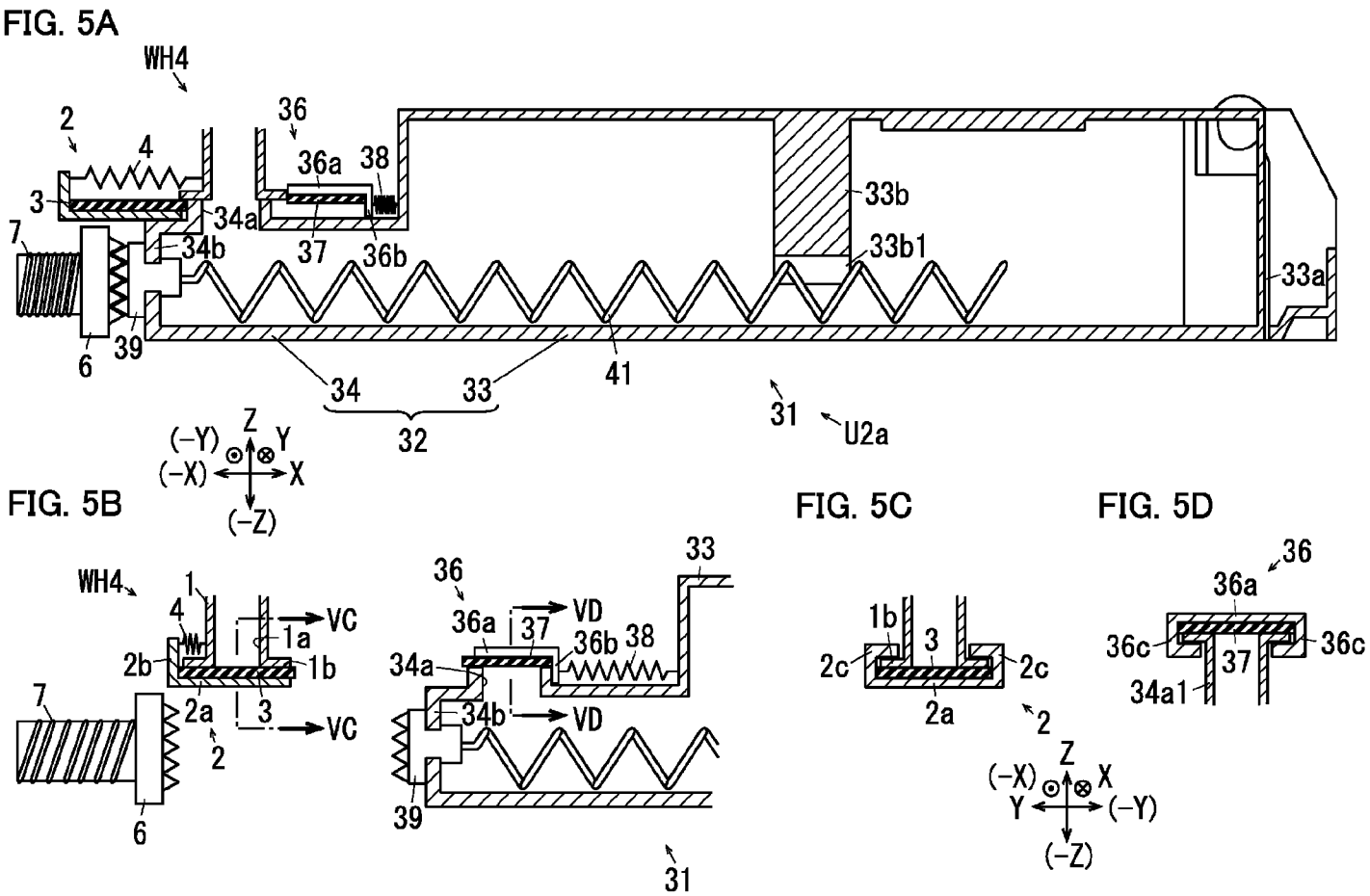
FIGS. 5A to 5D are diagrams of a box attaching/detaching portion.

FIGS. 5A to 5D are diagrams of the box attaching/detaching portion, FIG. 5A is a diagram of a state where a waste toner box is attached to the box attaching/detaching portion, FIG. 5B is a diagram of a case where the waste toner box is attached or detached to or from the box attaching/detaching portion, FIG. 5C is a sectional view taken along line VC-VC in FIG. 5B, and FIG. 5D is a sectional view taken along line VD-VD in FIG. 5B.

Referring to FIGS. 5A to 5D, a discharging path 1 which is downward extended is formed in the upper right end, i.e., the downstream end of the waste toner discharging path WH4. A discharging port 1*a* formed in the lower end of the discharging path 1. A flange portion 1*b* which is an example of a shielding member supporting member is formed in the periphery of the discharging port 1*a*.

A shutter 2 which is an example of a closing member is supported by the flange portion 1*b* so that the shutter is movable between a closing member opened position shown in FIG. 5A and a closed position shown in FIG. 5B.

The shutter 2 has a plate-like body portion 2*a* which is extended in the front and rear directions. Referring to FIGS. 5A and 5B, an urging member supporting portion 2*b* which is upward extended is formed in a rear end side of the body portion 2*a*.

Referring to FIG. 5C, a hooking portion 2*c* which can be hooked by the flange portion 1*b* is formed in the right and left ends of the body portion 2*a*. Therefore, the shutter 2 is moved along the flange portion 1*b* in the front and rear directions.

A sealing member 3 which is an example of a leak preventing member is supported on the upper face of the body portion 2*a* of the shutter 2. In the case where the shutter 2 is held to the closed position, the sealing member 3 hermetically seals the gap between the shutter 2 and the discharging port 1*a*.

A pull spring 4 which is an example of a closing member urging member is supported between the urging member supporting portion 2*b* of the shutter 2 and the discharging path 1. The shutter 2 is urged by the pull spring 4 so that the shutter is held to the closed position shown in FIG. 5B where the shutter closes the discharging port 1*a*.

A coupling 6 which is an example of a driving transmitting member is rotatably supported below and on the rear side of the discharging path 1 so that the coupling is movable between a coupled position shown in FIG. 5A and a separated position shown in FIG. 5B which is forward moved from the coupled position. The coupling 6 is urged so as to be held to the separated position shown in FIG. 5B, by a coil spring 7 which is an example of a coupling auxiliary member. The coupling 6 is rotated by a driving source which is not shown.

Figure 6:
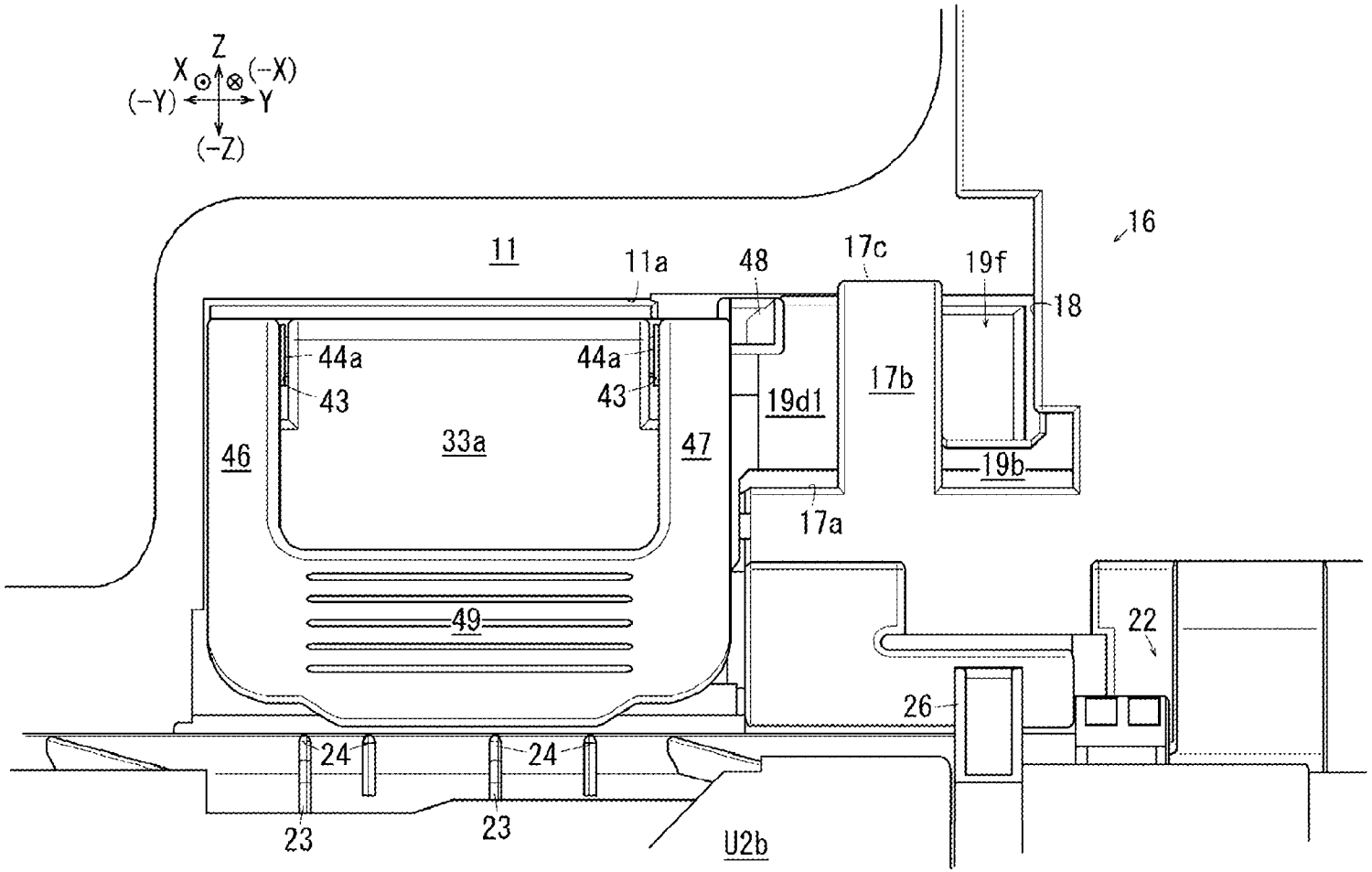
FIG. 6 is a diagram of a state where a front cover in Exemplary embodiment 1 is opened, and the waste toner box is attached.

FIG. 6 is a diagram of a state where a front cover in Exemplary embodiment 1 is opened, and the waste toner box is attached.

Figure 7:
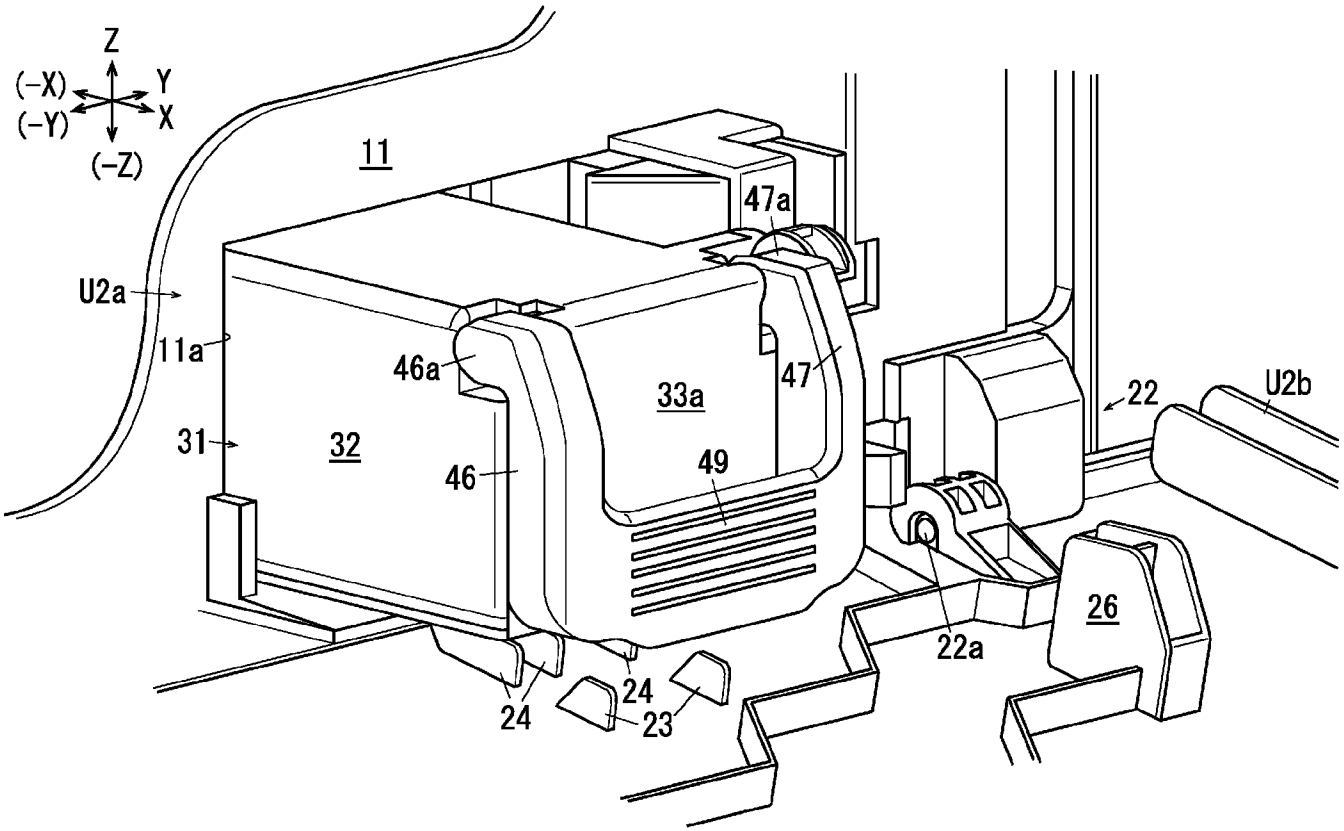
FIG. 7 is a perspective view of a state where the front cover in Exemplary embodiment 1 is opened, and the waste toner box is attached or detached.

FIG. 7 is a perspective view of a state where the front cover in Exemplary embodiment 1 is opened, and the waste toner box is attached or detached.

Figure 8:
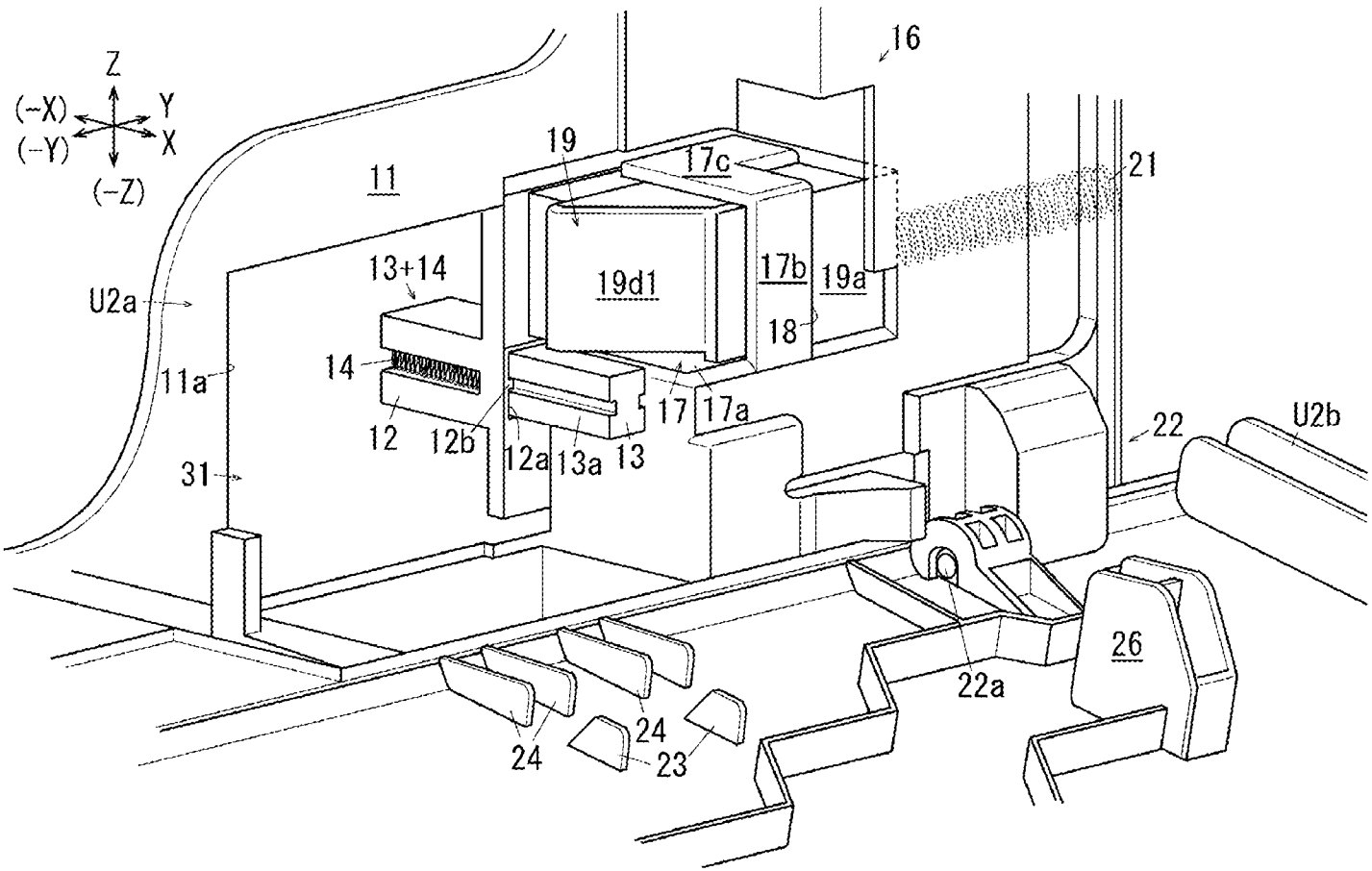
FIG. 8 is a perspective view of a box insertion port in a state where the front cover in Exemplary embodiment 1 is opened.

FIG. 8 is a perspective view of a box insertion port in a state where the front cover in Exemplary embodiment 1 is opened.

Referring to FIGS. 6 to 8, in front of the box attaching/detaching portion U2*a*, the front panel 11 which is an example of the outer face of the image forming apparatus main unit U2 is supported. The box insertion port 11*a* which is connected to the box attaching/detaching portion U2*a*, and which is an example of an opening is formed in the front panel 11.

Referring to FIG. 8, a spring housing portion 12 which is an example of an urging member housing portion extended in the front and rear directions that are an example of a detachable body drawing direction is formed on the right side of a vertical middle portion of the box insertion port 11*a*. An opened contacting member passing port 12*a* is formed in a front end portion of the spring housing portion 12. A stopper 12*b* which is inward projected toward the inner side of the spring housing portion 12, and which is an example of a slipping-off preventing portion is formed in the front end of the spring housing portion 12.

In the spring housing portion 12, a box contacting member 13 which is an example of a detachable body contacting member is supported so as to be movable in the front and rear directions. The box contacting member 13 is formed into a columnar shape which is extended in the front and rear directions correspondingly with the spring housing portion 12. A guided groove 13*a* which is extended in the front and rear directions correspondingly with the spring housing portion 12, and which is an example of a guided groove is formed in the box contacting member 13. A slipping-off preventing portion (not shown) which is contacted with the stopper 12*b* to prevent the box contacting member 13 from slipping off is formed in the rear end of the guided groove 13*a*.

The box contacting member 13 is supported so as to be movable between a projected position shown in FIG. 8 where the stopper 12*b* and the slipping-off preventing portion are contacted with each other, and the member is projected from the contacting member passing port 12*a* of the spring housing portion 12, and an embedded position where the stopper 12*b* and the slipping-off preventing portion are separated from each other, and the member is embedded in the contacting member passing port 12*a* of the spring housing portion 12.

A pushing coil spring 14 which is an example of a pushing urging member is supported in rear of the box contacting member 13. One end of the pushing coil spring 14 is supported by the rear end of the spring housing portion 12, and the other end is supported by a rear end portion of the box contacting member 13. According to the configuration, the pushing coil spring 14 urges the box contacting member 13 in the front direction which is directed toward the downstream side in the detachable body drawing direction.

Therefore, the box contacting member 13 is normally held to the projected position by the elastic force of the pushing coil spring 14. When the box contacting member 13 is urged in the rear direction, the member is moved to the embedded position against the urging force of the pushing coil spring 14.

The box contacting member 13 and the pushing coil spring 14 constitute a box pushing member 13+14 which is an example of a pushing member in Exemplary embodiment 1.

A latch attaching portion 16 which is an example of a locking member attaching portion is formed above and on the right side of the spring housing portion 12. The latch attaching portion 16 has: a lower bottom plate 17*a* which is forward extended from the front panel 11; a front side plate 17*b* which is upward extended from the left side of a front end portion of the bottom plate 17*a*; and an upper side plate 17*c* which is extended from the side plate 17*b* toward the front panel 11. A space surrounded by the bottom plate 17*a*, the front side plate 17*b*, the upper side plate 17*c*, and the front panel 11 forms a latch moving portion 17 which is extended in the right and left directions that are an example of a direction perpendicular to the detachable body drawing direction, and which is an example of a locking member moving portion.

A boss passing port 18 through which the interior and exterior of the latch moving portion 17 communicate with each other, and which is an example of an opening portion is formed on the right side of the front side plate 17*b* of the latch moving portion 17 and on the right side of a front end portion of the upper side plate 17*c*.

Figure 9A:
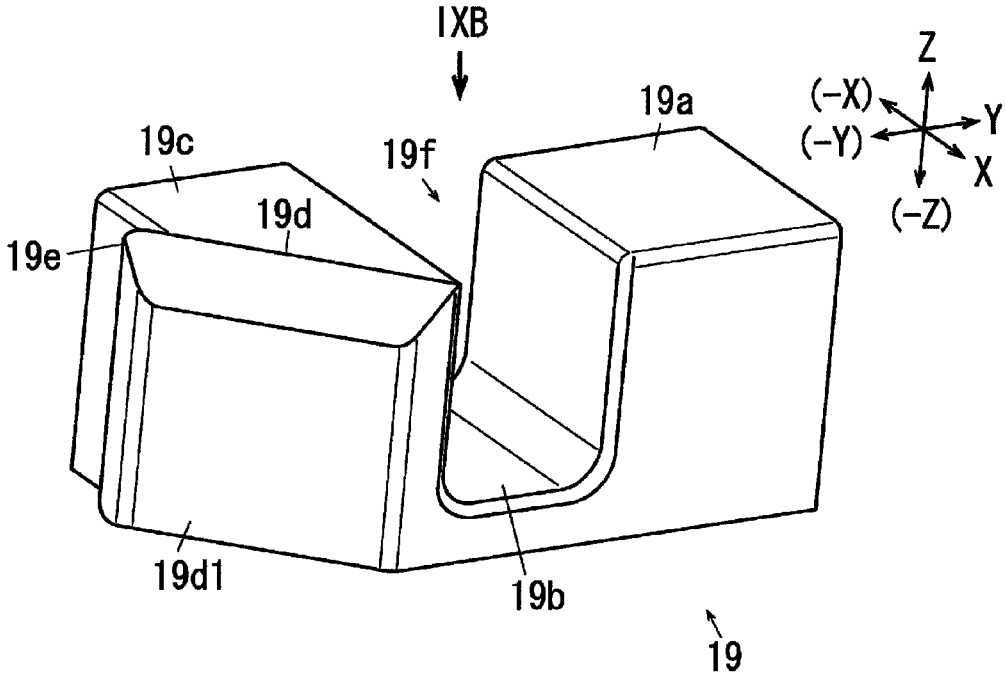
FIGS. 9A and 9B are enlarged views of a latch.
Figure 9B:
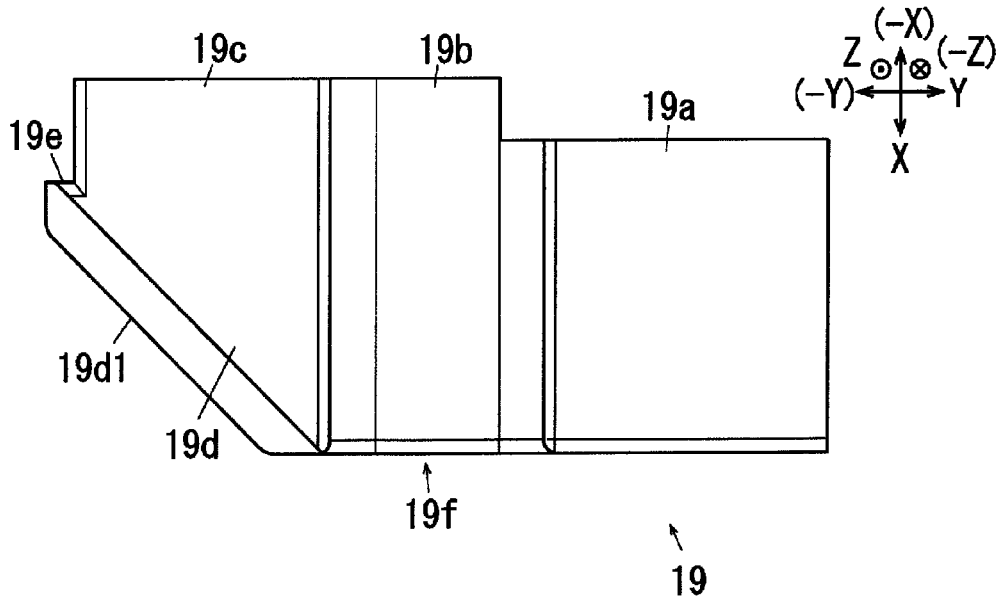

FIGS. 9A and 9B are enlarged views of a latch, FIG. 9A is a perspective view, and FIG. 9B is a view as seen in the direction of arrow IXB in FIG. 9A.

Referring to FIG. 8, in the latch moving portion 17 of the latch attaching portion 16, a latch 19 which is projectable into the box attaching/detaching portion U2*a*, and which is an example of the locking member is supported so as to be movable in the right and left directions.

Referring to FIGS. 9A and 9B, in the right end, the latch 19 has a spring receiving portion 19*a* which is formed into a rectangular parallelepiped shape, and which is an example of an urging member receiving portion. A plate-like coupling portion 19*b* which is longer in length in the front and rear directions and thinner in thickness in the upper and lower directions as compared with the spring receiving portion 19*a* is integrally formed in a lower portion of the left end of the spring receiving portion 19*a*. The coupling portion 19*b* is formed flushly with the front face of the spring receiving portion 19*a*, and projected from the rear face of the spring receiving portion 19*a*.

A rear latching portion 19*c* which has a rectangular parallelepiped shape, and which is an example of a rear locking portion is integrally formed in a lower portion of the left end of the coupling portion 19*b*. A front latch portion 19*d* which has a rectangular triangular prism-like shape, which has a guided face 19*d*1 that is longer in width than the width of a front end portion of the rear latching portion 19*c*, and which is an example of a front locking portion is integrally formed in a front portion of the left end of the coupling portion 19*b*. The guided face 19*d*1 which is further rearward inclined as more advancing in the left direction is formed in a left portion of the front face of the front latch portion. A hooking portion 19*e* is formed in the left end of the front latch portion 19*d*, i.e., a rear end portion of the front latch portion 19*d* which is projected in the left direction as compared with the rear latching portion 19*c*.

Figures 10A, 10B, 10C, 10D:
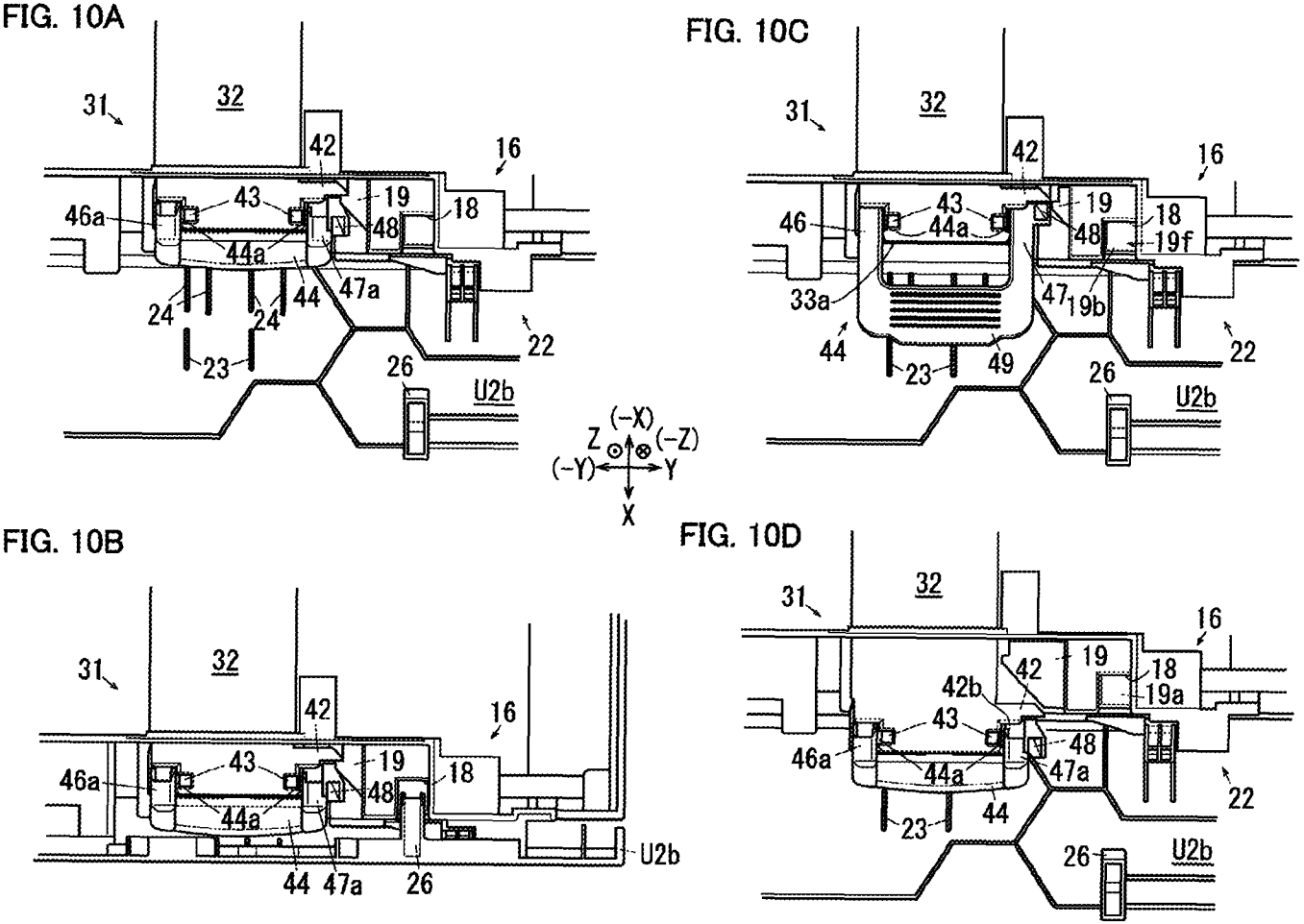
FIGS. 10A to 10D are views as seen from the upper side in FIG. 6 to the lower side.

FIGS. 10A to 10D are views as seen from the upper side in FIG. 6 to the lower side, FIG. 10A is a view of a case where the front cover is held to an opened position, FIG. 10B is a view of a case where the front cover is held to a normal position, FIG. 10C is a view corresponding to FIG. 10A and showing a state where a box handle is moved to a drawn position, and FIG. 10D is a view of a case where the waste toner box is attached or detached, and showing a state where the latch is held to a separation projected position.

The spring receiving portion 19*a*, the coupling portion 19*b*, the rear latching portion 19*c*, and the front latch portion 19*d* constitute the latch 19 in Exemplary embodiment 1.

In the latch 19, a space surrounded by the spring receiving portion 19*a*, the coupling portion 19*b*, the rear latching portion 19*c*, and the front latch portion 19*d* constitutes a boss receiving recess 19*f* which is an example of an opening/closing projected portion receiving recess in Exemplary embodiment 1.

The latch 19 which is movably supported by the latch moving portion 17 is moved in the right and left directions between a separation projected position shown in FIG. 10D where the latch is projected into the attaching/detaching portion U2*a*, and the front face of the spring receiving portion 19*a* is exposed from the boss passing port 18, and a canceled position shown in FIG. 10C where the boss receiving recess 19*f* is exposed from the boss passing port 18.

Referring to FIG. 8, a latch coil spring 21 which is an example of a locking urging member is supported on the right side of the spring receiving portion 19*a* of the latch 19. One end of the latch coil spring 21 is supported by the right side face of the spring receiving portion 19*a* of the latch 19, and the other end is supported by a right end portion of the latch moving portion 17.

According to the configuration, the latch 19 receives an urging force which is exerted by the elastic force of the latch coil spring 21, and which moves the latch in the left direction.

(Description of Front Cover)

Figure 11B:
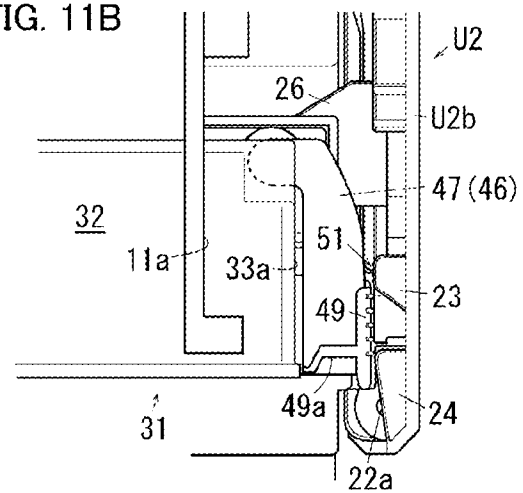
FIGS. 11A to 11C are views as seen from the left side in FIG. 6 to the right side.
Figure 11A:
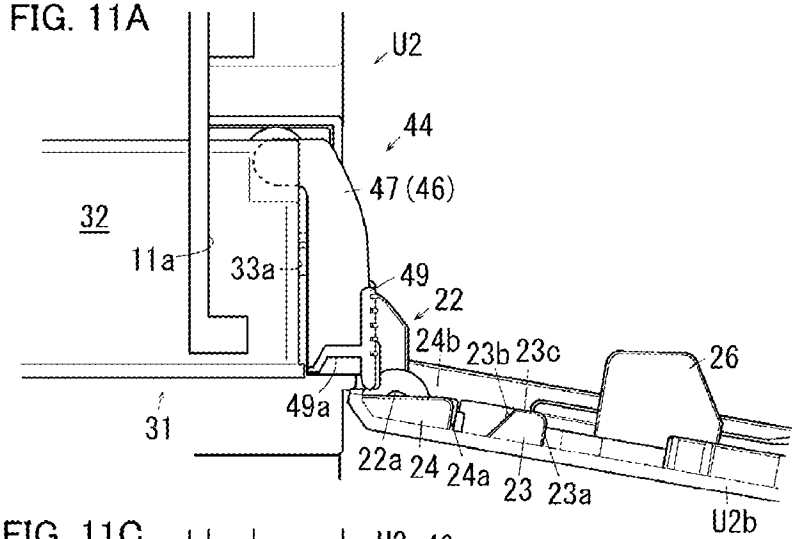
Figure 11C:
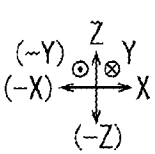
Figure 11C:
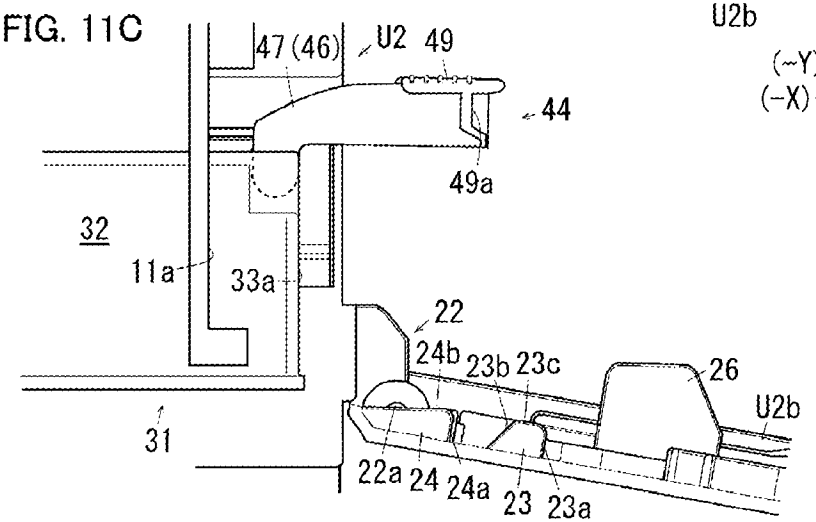

FIGS. 11A to 11C are views as seen from the left side in FIG. 6 to the right side, FIG. 11A is a view of a case where the front cover is held to the opened position, FIG. 11B is a view of a case where the front cover is held to the normal position, and FIG. 11C is a view corresponding to FIG. 11A and showing a state where the box handle is moved to the drawn position.

Referring to FIGS. 6, 10A to 10D, and 11A to 11C, a hinge 22 which is an example of an opening/closing member supporting member is disposed below the latch attaching portion 16 of the image forming apparatus main unit U2. A hinge shaft 22*a* which is an example of an opening/closing member support shaft is supported by the hinge 22. A front cover U2*b* which is an example of an opening/closing member is supported by the hinge shaft 22*a*. The front cover U2*b* is supported so as to be rotatable about the hinge shaft 22*a* between the opened position shown in FIGS. 6, 10A, and 11A where the box insertion port 11*a* is exposed to the outside, and the normal position shown in FIGS. 10B and 11B where the box insertion port 11*a* is externally closed.

First ribs 23 which are an example of a first restricted portion are formed in the face of the front cover U2*b* on the side of the image forming apparatus main unit U2, i.e., the upper face in the opened position shown in FIGS. 10A and 11A. In the case where the front cover U2*b* is moved to the normal position, the first ribs are located in front of a vertical middle portion of the box insertion port 11*a*, and projected toward the image forming apparatus main unit U2. The first ribs 23 are formed into a rail-like shape which is extended in the front and rear directions, and which is projected in the upper direction, and as a pair of right and left ribs.

Edge portions 23*a* which are upward extended are formed in front end potions of the first ribs 23. Guiding edge portions 23*b* which are further upward inclined as more forward advancing, and which are an example of a guiding portion are formed in end portions of the first ribs 23 on the sides of the hinge 22, i.e., rear end portions. In the first ribs 23, edge portions 23*c* through which upper end portions of the edge portions 23*a* and those of the guiding edge portions 23*b* are coupled with each other are formed, and the edge portions 23*c* are laterally extended along the surface of the front cover U2*b*.

In the opened position shown in FIGS. 10A and 11A, second ribs 24 which are disposed on the side of the hinge 22 as compared with the first ribs 23, i.e., on the rear side as compared with the first ribs 23, which are projected to the upper side that is on the side of the image forming apparatus main unit U2, and which are an example of a second restricted portion are formed on the upper face of the front cover U2*b*. The second ribs 24 are formed into a rail-like shape which is extended in the front and rear directions, and which is projected in the upper direction, and arranged as four ribs in the right and left directions.

Edge portions 24*a* which are upward extended are formed in front end potions of the second ribs 24. Edge portions 24*b* which are rearward extended from upper end portions of the edge portions 24*a* to a rear end portion of the front cover U2*b* along the surface of the front cover U2*b* are formed in the second ribs 24.

As shown in FIGS. 6, 8, and 10A to 10D, a cover boss 26 which, in the case where the front cover U2*b* is held to the normal position, can be passed through the boss passing port 18 in the latch attaching portion 16, and which is an example of an opening/closing projected portion is formed on the face of the front cover U2*b* on the side of the image forming apparatus main unit U2. When the front cover U2*b* is held to the normal position, the cover boss 26 is housed in the boss passing port 18 as shown in FIG. 10B.

(Description of Waste Toner Box)

Referring to FIGS. 5A to 8, a waste toner box 31 which is an example of the detachable body is detachably attached to the box attaching/detaching portion U2*a*. The waste toner box 31 has a container main unit 32 which is extended in the front and rear directions, which has a hollow box-like shape, and which is an example of a detachable body main unit.

Referring to FIG. 5A, the container main unit 32 has a front housing portion 33 having a housing portion front wall 33*a* which is an example of a detachable body main unit downstream end face, and a rear recovery connecting portion 34 which is lower in height than the housing portion 33.

Inside the housing portion 33, an agitator pressing portion 33*b* which is downward extended from an upper end portion of the housing portion, and which is an example of a conveying member pressing portion is formed in the middle of the front and rear directions. An agitator pressing face 33*b*1 which has a semi-cylindrical sectional shape, and which is an example of a pressing face is formed in a lower end portion of the agitator pressing portion 33*b*.

An inflow port 34*a* which is upward opened, and which can be connected to the discharging port 1*a* of the discharging path 1 is formed in an upper portion of the recovery connecting portion 34. As shown in FIG. 5D, a flange portion 34*a*1 which is extended in the front and rear directions is formed in the right and left ends of the inflow port 34*a*.

A coupling supporting portion 34*b* which is an example of a driven member supporting portion is formed in the lower rear end of the inflow port 34*a*.

A box shutter 36 which is an example of a detachable body closing member is supported by the flange portion 34*a*1 so as to be movable in the front and rear directions between a closing member opened position shown in FIG. 5A where the inflow port 34*a* is opened, and a closed position shown in FIG. 5*b* where the shutter hermetically seals the inflow port 34*a*.

The box shutter 36 has a plate-like body portion 36*a* which is extended in the front and rear directions. Referring to FIGS. 5A and 5B, an urging member supporting portion 36*b* which is downward extended is formed in the front end side of the body portion 36*a*.

Referring to FIG. 5D, hooking portions 36*c* which can be hooked with the flange portion 34*a*1 are formed in the right and left ends of the body portion 36*a*. According to the configuration, the box shutter 36 is anteroposteriorly moved along the flange portion 34*a*1.

In the box shutter 36, a sealing member 37 which is an example of a leak preventing member is supported on lower face of the body portion 36*a*. In the case where the box shutter 36 is held to the closed position, the sealing member 37 hermetically seals the gap between the box shutter 36 and the inflow port 34*a*.

A coil spring 38 which is an example of a closing member urging member is supported between the urging member supporting portion 36*b* of the box shutter 36 and the housing portion 33. The box shutter 36 is urged by the coil spring 38 so that the shutter is held to the closed position shown in FIG. 5B where the shutter closes the inflow port 34*a*.

A box coupling 39 which meshes with the coupling 6 so that the driving is transmitted, and which is an example of the driven member is rotatably supported by the coupling supporting portion 34*b*. One end of an agitator 41 which is extended in the front and rear directions, and which is an example of a linear spiral conveying member is supported by the inner end of the box coupling 39. In the agitator 41, the other end side is extended more forward than the agitator pressing portion 33*b*, and the front side is pressed by the agitator pressing portion 33*b*.

When the box coupling 39 meshes with the coupling 6 to be rotated, the agitator 41 in the recovery container 32 is rotated, and the waste toner which flows from the inflow port 34*a* into the recovery connecting portion 34 is conveyed toward the housing portion 33. Even when the amount of the waste toner in the housing portion 33 is then increased and the front end side of the agitator 41 receives a force from the waste toner, the agitator 41 is pressed by the agitator pressing portion 33*b*. Namely, the agitator 41 is upward curved, so that occurrence rate of a conveyance failure is reduced.

Figure 12A:
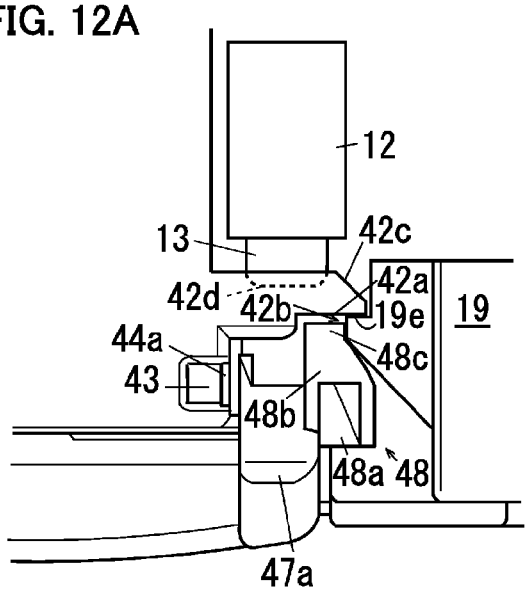
FIGS. 12A and 12B are views of a projected portion.
Figure 12B:
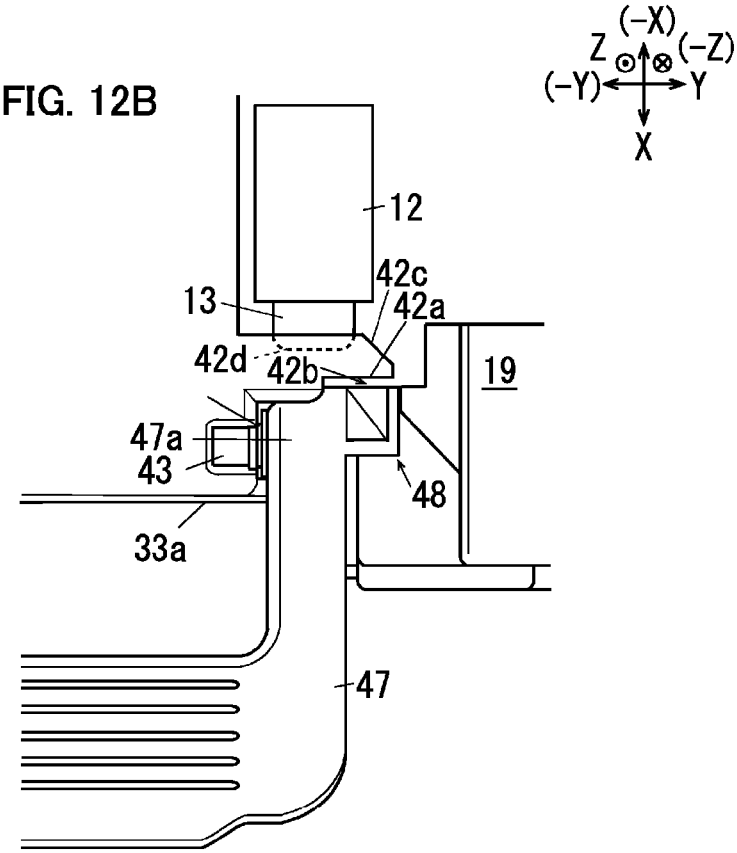

FIGS. 12A and 12B are views of a container projected portion, FIG. 12A is an enlarged view of main portions of FIG. 10A, and FIG. 12B is an enlarged view of main portions of FIG. 10C.

Referring to FIGS. 10A to 10D, and 12A and 12B, a container projected portion 42 which is vertically extended, which is rightward projected, and which is an example of an engaging portion is integrally formed in the right side of the downstream portion of the container main unit 32 in the detachable body main unit drawing direction, i.e., the front right side of the housing portion 33. A latch contacting portion 42*a* which is cut away into a rectangular sectional shape, which can be contacted with the latch 19, and which is an example of a locking member contacting portion is formed in the right front end of the container projected portion 42. The space in front of the latch contacting portion 42*a* constitutes a latch housing portion 42*b* which is an example of a locking member housing portion (i.e., a space on the side of the container main unit 32 in which the left end hooking portion 19*e* of the latch 19 for holding the container main unit 32 to the attachment position to the image forming apparatus main unit U2 is contacted with the latch contacting portion 42*a* and housed).

In the case where the container main unit 32 is attached to the box attaching/detaching portion U2*a*, the latch 19 held to the locked position is housed in the latch housing portion 42*b*. Namely, the latch 19 in Exemplary embodiment 1 is movable between the locked position where the left end hooking portion 19*e* of the latch 19 is contacted with the container main unit 32, and the canceled position where the latch is moved from the locked position to the right side that is an example of the direction in which the latch is separated from the container main unit 32. The locked position is set to a position between the separation projected position and the canceled position.

A latch guiding face 42*c* which is further leftward inclined as more rearward advancing, and which is an example of a guiding face is formed in the right end of the container projected portion 42. A pushing member receiving portion 42*d* which can be contacted with the box pushing member 13+14, and which is an example of a pushing member contacting portion is formed below the container projected portion 42 and on the left side of the latch guiding face 42*c*.

A pair of right and left handle supporting recesses 43 which are an example of a gripping portion supporting portion are formed above the housing portion front wall 33*a* in the downstream end of the container main unit 32 in the detachable body main unit drawing direction, i.e., in front of the container projected portion 42. A box handle 44 which is an example of a gripping portion is supported by the handle supporting recesses 43 so as to be rotatable about a handle shaft 44*a* which is extended in the right and left directions, and which is an example of a gripping portion support shaft.

Referring to FIGS. 6, 10A to 10D, and 11A to 11C, the box handle 44 has a pair of left and right handle arms 46, 47 which are vertically extended, and which are an example of a support arm portion. Supported portions 46*a*, 47*a* which are rearward extended are integrally formed on the upper ends of the handle arms 46, 47. The handle shaft 44*a* which is inward projected in the direction along the hinge shaft 22*a* supporting the front cover U2*b*, i.e., the right and left directions is integrally formed on the supported portions 46*a*, 47*a*.

A cancel projected portion 48 which is rearward projected is integrally formed at a position corresponding to the latch housing portion 42*b* on the right side of an upper end portion of the right handle arm 47.

Referring to FIGS. 12A and 12B, a latch cancelling portion 48*a* which has a lateral width corresponding to the latch housing portion 42*b*, and which is an example of a cancelling portion is formed in the front end side of the cancel projected portion 48. A latch guiding portion 48*b* in which the left end side is formed to be flush with the latch cancelling portion 48*a*, and the width is smaller as more rearward advancing, and which is an example of a locking member guiding portion is formed in rear of the latch cancelling portion 48*a*. A locking opposing portion 48*c* in which the width is smaller than the latch cancelling portion 48*a*, and corresponds to that of the rear end of the latch guiding portion 48*b* is formed in rear of the latch guiding portion 48*b*. The locking opposing portion 48*c* is opposed to a left end portion of the latch 19 at the locked position where the hooking portion 19*e* is contacted with the latch contacting portion 42*a*.

The latch cancelling portion 48*a*, the latch guiding portion 48*b*, and the locking opposing portion 48*c* constitute the cancel projected portion 48 in Exemplary embodiment 1.

Referring to FIGS. 6, 7, and 11A to 11C, a grip portion 49 which is extended in the right and left directions, and which is an example of a gripping portion main unit is integrally formed between lower end portions of the left and right handle arms 46, 47.

Referring to FIG. 11A, a rib housing recess 49*a* which has a shape that is upward recessed from the lower face, and which is an example of a restricting portion is formed in the lower end of the grip portion 49. The rib housing recess 49*a* is configured by a recess which is extended in the right and left directions, so as to be contactable with and hookable on the first and second ribs 23, 24 of the front cover U2*b*.

The left and right handle arms 46, 47, the cancel projected portion 48, and the grip portion 49 constitute the box handle 44 in Exemplary embodiment 1.

The box handle 44 is supported so as to be rotatable between a waiting position shown in FIGS. 10A and 11A where the handle is extended along the housing portion front wall 33*a*, and a drawn position shown in FIGS. 10C and 11C where the handle stands from the housing portion front wall 33*a* in the perpendicular direction that is an example of inclination.

The latch cancelling portion 48*a* disposed in the box handle 44 is rotated about the handle shaft 44*a* in conjunction with the movement of the box handle 44 between the drawn position and the canceled position, to move between an advanced position shown in FIGS. 10C and 12B in which the portion enters the latch housing portion 42*b*, and which is an example of a contacted position, and a retracted position shown in FIGS. 10A and 12A in which the portion is retracted from the interior of the latch housing portion 42*b*, and which is an example of a separated position. Namely, the latch cancelling portion 48*a* in Exemplary embodiment 1 is moved between the advanced position in which the portion is contacted with the latch 19, and which is an example of the contacted position, and the retracted position in which the portion is separated from the latch 19 as compared with the contacted position, and which is an example of the separated position.

The container main unit 32, the box shutter 36, the box coupling 39, the agitator 41, the box handle 44, and the like constitute the waste toner box 31 in Exemplary embodiment 1.

The waste toner box 31 is inserted or extracted by moving between an attached position shown in FIGS. 5A, 6, 10A to 10D, and 11A to 11C where the container main unit 32 is attached to the box attaching/detaching portion U2*a*, and a separated position where the container main unit is extracted from the box attaching/detaching portion U2*a* to the outside of the image forming apparatus main unit U2.

When the waste toner box 31 is held to the attached position, the box coupling 39 meshes with the coupling 6, both the shutter 2 and the box shutter 36 are held to the opened position, and the discharging port 1*a* of the discharging path 1 and the inflow port 34*a* of the recovery connecting portion 34 are connected to each other.

Referring to FIG. 11B, in a state where the container main unit 32 of the waste toner box 31 is moved to the attached position and the front cover U2*b* is moved to the normal position, the first and second ribs 23, 24 are housed in a rib housing space 51 which is between the box handle 44 and the front cover U2*b*, and which is an example of a restricted portion housing space. In a state where the container main unit 32 of the waste toner box 31 is moved to the attached position and the latch 19 is moved to the locked position, as shown in FIGS. 10A and 12A, the container projected portion 42 of the waste toner box 31 is urged toward the downstream side in the detachable body main unit drawing direction by the box pushing member 13+14, and contacted with the hooking portion 19*e* of the latch 19 to be locked or subjected to a so-called latching operation. At this time, a left end portion of the latch 19 is housed in the latch housing portion 42*b* formed in the container main unit 32.

Function of Exemplary Embodiment 1

In the thus configured image forming apparatus U of Exemplary embodiment 1, images due to the toners are recorded onto the recording sheet S by the image recording apparatus U3.

At this time, the toners are supplied from the toner cartridges Ky to Kk to the image recording apparatus U3 through the toner dispensers TDy to TDk. In the toners supplied to the image recording apparatus U3, during the image forming operation, the toners which are recovered by the image carrier cleaners CLy to CLk and the belt cleaner CLb, and those discharged from the developing devices Gy to Gk, or so-called waste toner is conveyed through the waste toner discharging path WH4, and the like, and then recovered into the waste toner box 31 attached to the box attaching/detaching portion U2*a*. When the container main unit 32 of the waste toner box 31 is filled with waste toner, the waste toner box 31 is replaced with a new one.

In the case where the waste toner box 31 is detached from the box attaching/detaching portion U2*a*, when the front cover U2*b* is opened, the box handle 44 of the waste toner box 31 is exposed to the outside. When the box handle 44 is gripped by the worker, the box handle 44 is rotated about the handle shaft 44*a* from the waiting position toward the drawn position. At the same time, the latch cancelling portion 48*a* of the box handle 44 is rotated about the handle shaft 44*a* from the retracted position toward the advanced position.

As shown in FIG. 12B, therefore, the latch guiding portion 48*b* and latch cancelling portion 48*a* of the cancel projected portion 48 sequentially enter the latch housing portion 42*b* in which the latch 19 is housed.

When the latch guiding portion 48*b* is rearward moved to enter the latch housing portion 42*b*, the latch guiding portion 48*b* and the guided face 19*d*1 of the latch 19 are contacted with each other, and the latch 19 is pushed out from the latch housing portion 42*b* toward the canceled position against the urging force of the latch coil spring 21. When the latch cancelling portion 48*a* then enters the latch housing portion 42*b*, the latch cancelling portion 48*a* and the left end portion of the latch 19 are contacted with each other, and the latch 19 is held to the canceled position shown in FIG. 12B which is rightward retracted from the latch housing portion 42*b*.

Therefore, the latch 19 is held to the state where the latch is separated from the container projected portion 42 of the container main unit 32, and the latching of the waste toner box 31 is cancelled. By the urging force which is applied from the pushing coil spring 14 through the box contacting member 13, the waste toner box 31 is moved toward the downstream side in the detachable body main unit drawing direction which is the direction directed from the attaching direction to the separated position, i.e., toward the front side. When the worker forward pulls the box handle 44 while gripping the handle, the waste toner box 31 is pulled out to the separated position where the box is detached from the image forming apparatus main unit U2.

Referring to FIG. 5, at this time, the discharging port 1*a* of the discharging path 1 is closed by the shutter 2 which is moved to the closed position by the pull spring 4, and the inflow port 34*a* of the container main unit 32 is closed by the box shutter 36 which is moved to the closed position by the coil spring 38. When the coupling 6 is separated from the box coupling 39, the coupling is moved from the coupled position to the front side or the separated position.

In a configuration where the latch 19 is not moved from the locked position to the canceled position in conjunction with the movement of the box handle 44 from the waiting position to the pulled position, two operations of canceling the latch 19, and gripping the box handle 44 to pull out the waste toner box 31 are required.

In Exemplary embodiment 1, by contrast, when the waste toner box 31 is to be pulled out, the latch 19 is automatically cancelled by simply moving the box handle 44 from the waiting position to the pulled position. As compared with the configuration where the latch 19 is not moved in conjunction with the operation of the box handle 44, the operation procedure is simplified.

In Exemplary embodiment 1, particularly, the cancel projected portion 48 is formed integrally with the box handle 44. As compared with a case where the box handle 44 and the cancel projected portion 48 are separately configured, the movement of the latch 19 can be interlocked with that of the box handle 44 by a simple configuration in which the number of components is reduced.

When the waste toner box 31 is forward moved from the attached position in a state where the latch is cancelled, the latch 19 is sequentially contacted with the cancel projected portion 48 and the container projected portion 42, and the canceled position is held. When the container projected portion 42 is then forward moved from the position of the latch 19, the latch is moved from the locked position to the separation projected position by the urging force of the latch coil spring 21. Therefore, a state where the spring receiving portion 19*a* of the latch 19 closes the boss passing port 18 is attained.

At this time, if the front cover U2*b* is moved from the opened position to the normal position without attaching the waste toner box 31, the cover boss 26 is contacted with the spring receiving portion 19*a* closing the boss passing port 18, and the movement of the front cover U2*b* to the normal position is restricted, so that a state where the closing operation is disabled is produced. Therefore, it is possible to prevent the case where the waste toner box 31 is not attached, from occurring.

In the case where the waste toner box 31 is to be attached to the box attaching/detaching portion U2*a*, the waste toner box 31 is inserted from the rear end side into the box insertion port 11*a*, and then rearward moved. At this time, before the movement to the attached position, the container projected portion 42 of the container main unit 32 is contacted with the box contacting member 13 to receive the forward urging force from the pushing coil spring 14. Against the urging force of the pushing coil spring 14, the waste toner box 31 is rearward moved as it is to be moved to the attached position.

In this case, the latch guiding face 42*c* of the container projected portion 42 is contacted with the guided face 19*d*1 of the latch 19 which has been held to the separation projected position. In accordance with the movement of the waste toner box 31 to the attached position, the latch 19 is pushed by the latch guiding face 42*c* to be moved from the separation projected position shown in FIG. 10D to the cancel position shown in FIG. 10C. When the waste toner box 31 is moved to the attached position, the latch 19 is projected into the box attaching/detaching portion U2*a* by the urging force of the latch coil spring 21, and moved to the locked position where the latch is housed in the latch housing portion 42*b*. As a result, the attachment of the box attaching/detaching portion U2*a* of the waste toner box 31 is completed.

Referring to FIG. 5, the shutter 2 which closes the discharging port 1*a* is pushed by the waste toner box 31 to be moved to the closing member opened position, and the shutter 36 which closes the inflow port 34*a* is pushed by the discharging port 1*a* to be moved to the closing member opened position, whereby the discharging port 1*a* and the inflow port 34*a* are opened and connected to each other. The coupling 6 which has been held to the separated position meshes with the box coupling 39 to be rearward pushed, whereby the coupling is moved to the coupled position.

After the attachment of the waste toner box 31 is completed, when the front cover U2*b* is closed, the cover boss 26 is passed through the boss passing port 18. In the state where the cover boss 26 is housed in the boss receiving recess 19*f* of the latch 19, the front cover U2*b* is held to the normal position, and the image forming operation is performed.

When, in the course of pushing the waste toner box 31 toward the attached position, the latch 19 is pushed out to the canceled position and the latch coil spring 21 is compressed, the elastic resilient force of the latch coil spring 21 is increased, and the waste toner box 31 is pushed by the increased resilient force, thereby producing a resistance to the pushing operation. Also the coil spring 7 of the coupling 6, and the springs 4, 38 of the shutter 2 and the box shutter 36 exert resistances to the operation of pushing the waste toner box 31.

In the course of pushing the waste toner box 31 toward the attached position, therefore, the worker feels a load, and, although the box is in a semi-attached state, may misconceive that the movement to the attached position has been completed.

In a conventional configuration where the box pushing member 13+14 is not disposed, even when the force of pushing back the waste toner box 31 due to the coil spring 7 of the coupling 6, and the springs 4, 38 of the shutter 2 and the box shutter 36 is applied, the waste toner box 31 is pressed by the latch 19 because of the elastic resilient force of the latch coil spring 21, and the waste toner box 31 is not pushed back, so that the semi-attached state cannot be recognized.

In such a case, when the image forming operation is performed, the waste toner conveyed from the image recording apparatus U3 is discharged from the discharging port 1*a* although the connection of the discharging port 1*a* and the inflow port 34*a* has not been completed, and flows out into the box attaching/detaching portion U2*a*, thereby causing a possibility that the image forming apparatus main unit U2 may be contaminated.

In Exemplary embodiment 1, by contrast, the waste toner box 31 is forward urged by the box pushing member 13+14, and, in the case of the semi-attached state, the waste toner box 31 is forward pushed out, so that the latch 19 is moved to the separation projected position. In Exemplary embodiment 1, as compared with the configuration where the box pushing member 13+14 is not disposed, therefore, the waste toner box 31 is pushed by the box pushing member 13+14 to forward pop out, and the worker can easily recognize the semi-attached state of the waste toner box 31.

In Exemplary embodiment 1, the box contacting member 13 is contacted with the container projected portion 42 with which the latch 19 is contacted, thereby forward urging the waste toner box 31. In an assumed case where the box contacting member 13 is contacted with and urges a position which is separated from the container projected portion 42, such as a case where the member is contacted with and urges a rear end portion of the waste toner box 31, there is a case where the force of pushing out the waste toner box 31 due to the box contacting member 13 is absorbed by accumulation of shape errors of the waste toner box 31, elastic deformation, rattling, or the like, or, because of the relationship between the pushing direction of the box contacting member 13 and the direction of the force of the latch 19, the waste toner box 31 is not pushed by the box contacting member 13, but pressed by the latch 19, thereby causing the semi-attached state.

In Exemplary embodiment 1, by contrast, the box contacting member 13 forward presses the waste toner box 31 in the vicinity of the latch 19, influences due to accumulation of shape errors and the like are reduced, thereby reducing occurrences of the semi-attached state.

The box pushing member 13+14 in Exemplary embodiment 1 is moved in the front and rear directions which coincide with the moving direction of the waste toner box 31, to urge the waste toner box 31, and, as compared with the case where the member is not moved in the front and rear directions, the waste toner box 31 is forward pushed out by the pushing coil spring 14 of a small elastic force.

Figure 13A:
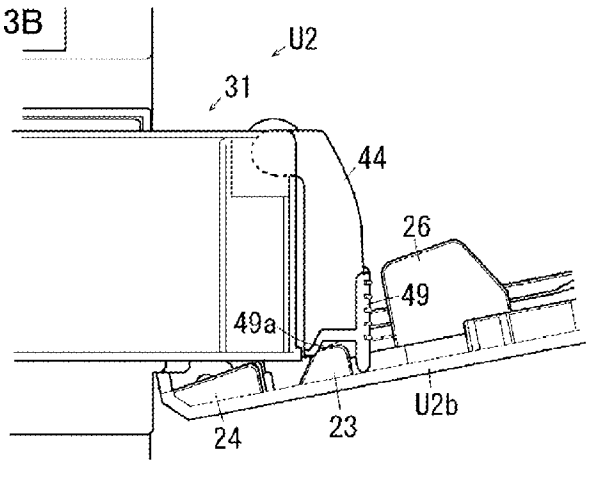
FIGS. 13A to 13D are views of a case where, when the waste toner box is held to a first semi-inserted position, the front cover is moved from the opened position toward the normal position.
Figure 13B:
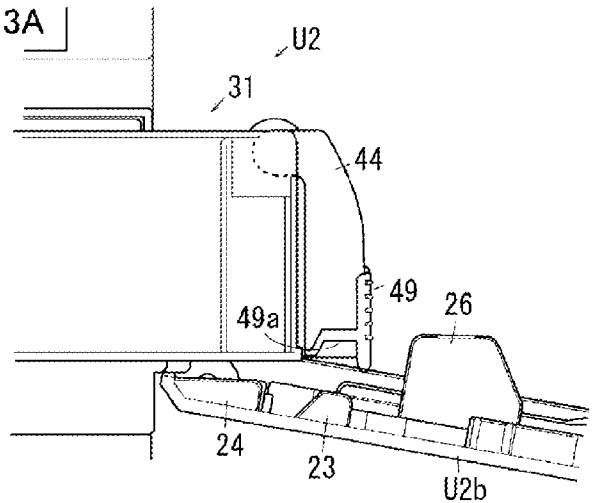
Figure 13C:
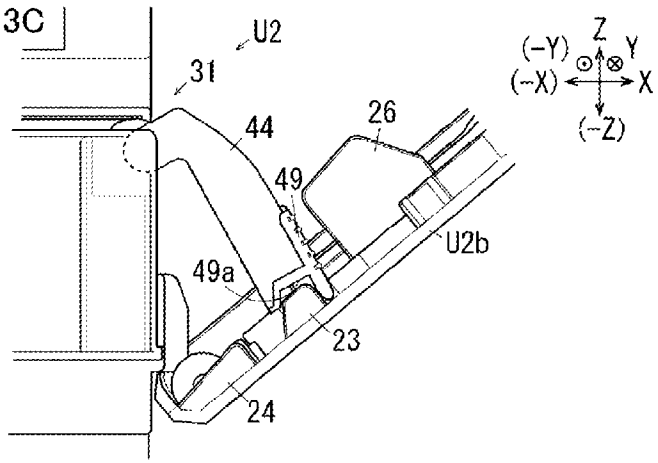
Figure 13D:
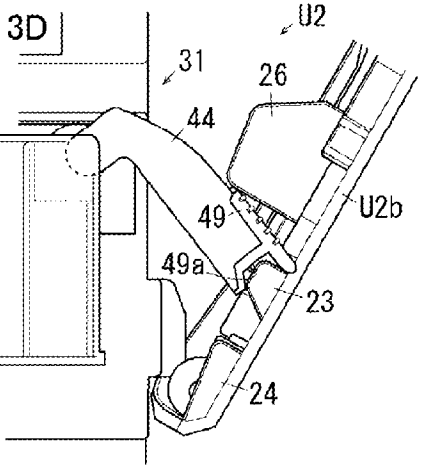

FIGS. 13A to 13D are views of a case where, when the waste toner box is held to a first semi-inserted position, the front cover is moved from the opened position toward the normal position, FIG. 13A is a view of a case where the front cover is held to the opened position, FIG. 13B is a view subsequent to FIG. 13A, and showing a state where the front cover is moved from the opened position and first ribs are contacted with the rib housing recess, FIG. 13C is a view subsequent to FIG. 13B, and FIG. 13D is a view subsequent to FIG. 13C, and showing a state where the front cover is restricted by the box handle.

Referring to FIGS. 13A to 13D, when the worker releases the grip in a semi-attached state of the waste toner box 31, the waste toner box 31 which is pushed by the box pushing member 13+14 is forward moved, and there may arise a case where the waste toner box is moved to the first semi-inserted position which is between the attached position and the separated position, which is preset, and which is an example of a first restricted position. In this case, when the worker releases the grip on the box handle 44, the box handle 44 is held to the waiting position by its own weight. When, without noticing the semi-attached state, the worker moves the front cover U2*b* from the opened position to the normal position, the first ribs 23 are contacted with the inside of the rib housing recess 49*a* as shown in FIG. 13B.

As shown in FIGS. 13B and 13C, in accordance with the rotational movement of the front cover U2*b* to the normal position, the box handle 44 receives the upward force and the rearward force to be rotated about the handle shaft 44*a*, and the waste toner box 31 is rearward pushed. As shown in FIG. 13D, in the case where the waste toner box 31 is moved to the attached position, even when the box handle 44 receives a rearward force, the waste toner box 31 is not rearward moved, and the box handle 44 restricts the rotational movement of the front cover U2*b* to the normal position.

In a conventional configuration, a holding member which is enabled or disabled to be moved in conjunction with attachment or detachment of a toner housing portion is contacted with an abutment member of an opening cover to restrict opening/closing of the opening cover. Namely, attachment/detachment of the toner housing portion and opening/closing of the opening cover are restricted through a separate member, i.e., the holding member.

In Exemplary embodiment 1, by contrast, in the case of the semi-attached state, the rotational movement of the front cover U2*b* is restricted and an incomplete attachment, i.e., a semi-attached state is determined, without interposing a member such as the holding member and by the simple configuration due to the contact of the waste toner box 31 and the front cover U2*b*.

In a configuration where the front cover U2*b* is contacted with the waste toner box 31 and the movement of the cover to the normal position is not restricted, when the front cover U2*b* is moved to the normal position, the waste toner box 31 held to the first semi-inserted position is contacted with the front cover U2*b* to be rearward moved.

In an assumed configuration where the waste toner box 31 is moved to the attached position in accordance with the movement of the front cover U2*b*, the strength which can withstand forces such as the urging forces of the coil ring 7 of the coupling 6 and the box pushing member 13+14 is required, and hence the production cost of the front cover U2*b* is increased.

When the front cover U2*b* has low strength, the waste toner box 31 receives a forward force due to the urging force of the coil ring 7 of the coupling 6 and the like, and the front cover U2*b* may be deformed to be moved between the front face of the front panel 11 and the front cover U2*b*, thereby causing the box to be held to a semi-attached state.

In Exemplary embodiment 1, in the case where the waste toner box 31 is held to the first semi-inserted position, by contrast, the front cover U2*b* is contacted with the waste toner box 31, and the rotation is restricted, so that the cover cannot be closed. In Exemplary embodiment 1, therefore, the worker is caused to know a semi-attached state by the simple configuration of a contact between members.

In Exemplary embodiment 1, the hinge shaft 22*a* of the front cover U2*b* is configured so as to have strength higher than the handle shaft 44*a* of the box handle 44. If the worker tries to close the front cover U2*b* by a strong force in a state where the rotational movement of the front cover U2*b* is restricted by the box handle 44, therefore, the handle shaft 44*a* on the side of the waste toner box 31 which is a detachable body is broken more easily than the hinge shaft 22*a* on the side of the image forming apparatus main unit U2.

In Exemplary embodiment 1, as compared with the configuration where the hinge shaft 22*a* is easily broken, the handle shaft 44*a* of the waste toner box 31 is easily broken, so that the side of the waste toner box 31 which is replaceable is easily broken instead of the image forming apparatus main unit U2. Even when a breakage occurs, therefore, repair or replacement can be easily performed.

Figures 14A, 14B, 14C, 14D:
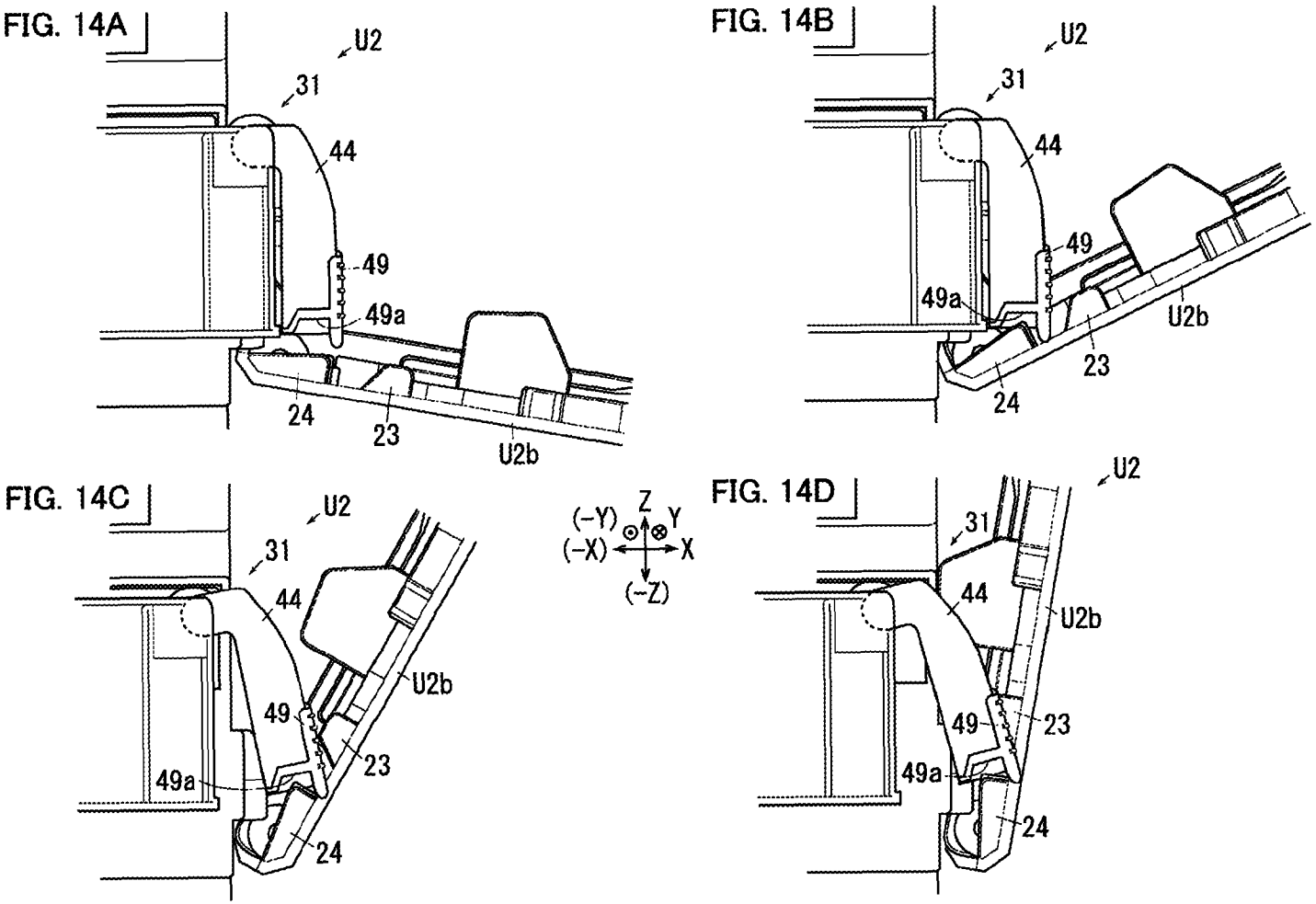
FIGS. 14A to 14D are views of a case where, when the waste toner box is held to a second semi-inserted position, the front cover is moved from the opened position toward the normal position.

FIGS. 14A to 14D are views of a case where, when the waste toner box is held to a second semi-inserted position, the front cover is moved from the opened position toward the normal position, FIG. 14A is a view of a case where the front cover is held to the opened position, FIG. 14B is a view subsequent to FIG. 14A, and showing a state where the front cover is moved from the opened position and the second ribs are contacted with the rib housing recess, FIG. 14C is a view subsequent to FIG. 14B, and FIG. 14D is a view subsequent to FIG. 14C, and showing a state where the front cover is restricted by the box handle.

Referring to FIGS. 14A to 14D, in the case where the worker releases the grip in a semi-attached state of the waste toner box 31, the waste toner box 31 which is pushed by the box pushing member 13+14 is forward moved, and, depending on the amount of the waste toner recovered into the waste toner box 31 or the moment of the movement, may be moved to the second semi-inserted position which is preset between the attached position and the first semi-inserted position, and which is an example of a second restricted position.

At this time, in a similar manner as the case where the waste toner box 31 is moved to the first semi-inserted position, when, without noticing the semi-attached state, the worker moves the front cover U2*b* from the opened position to the normal position, the second ribs 24 are contacted with the inside of the rib housing recess 49*a* as shown in FIG. 14B. As shown in FIGS. 14C and 14D, in a similar manner as the case where the box handle 44 is contacted with the first ribs 23, the box handle 44 in a state where the handle is contacted with the second ribs 24 restricts the rotational movement of the front cover U2*b* to the normal position.

Also in the case where the waste toner box 31 is moved to the second semi-inserted position, in a similar manner as the case where the box is moved to the first semi-inserted position, therefore, the worker is caused to know a semi-attached state.

In Exemplary embodiment 1, in the case where the waste toner box 31 is held to the side of the separated position with respect to the first semi-inserted position, when the front cover U2*b* is closed, the waste toner box 31 is contacted with the inner face of the front cover U2*b* which is remote from the hinge 22 as compared with the first ribs 23. Therefore, the component of the force of pushing the waste toner box 31 is so small that the waste toner box 31 is little moved, and the rotational movement of the front cover U2*b* is restricted.

Figure 15A:
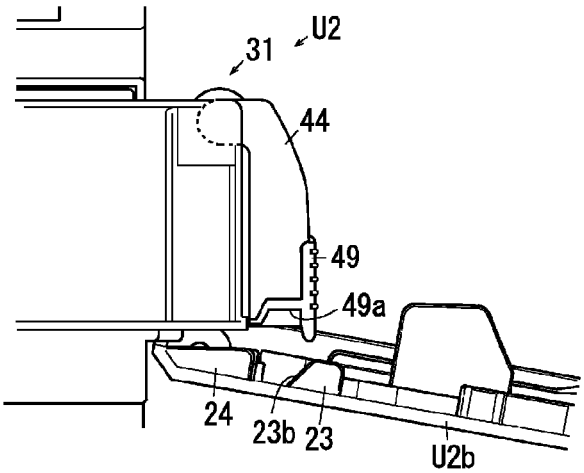
FIGS. 15A to 15E are views of a case where, when the waste toner box is held between the first semi-inserted position and the second semi-inserted position, the front cover is moved from the opened position toward the normal position.
Figure 15D:
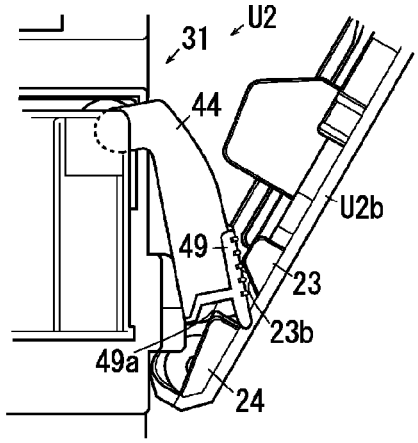
Figure 15B:
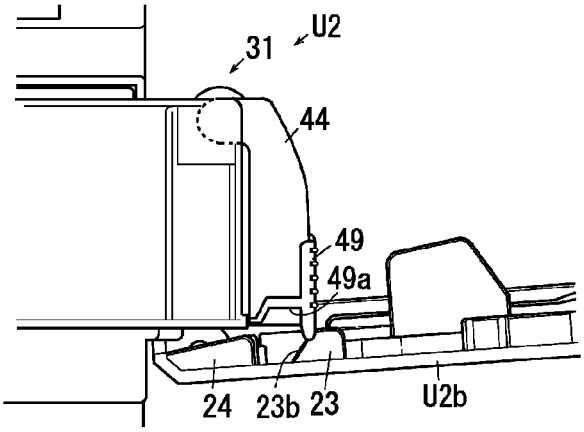
Figure 15E:
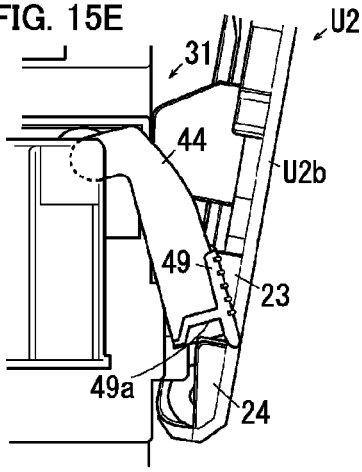
Figure 15C:
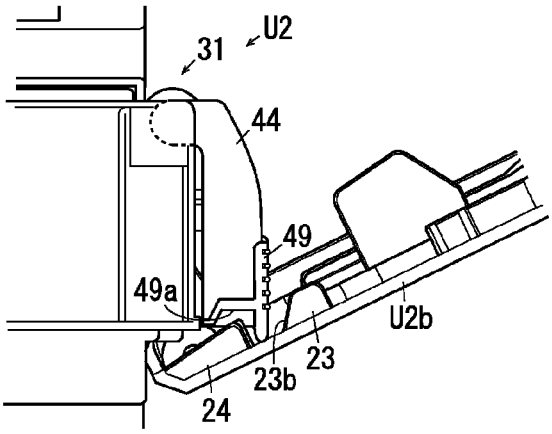
Figure 15C:
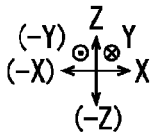

FIGS. 15A to 15E are views of a case where, when the waste toner box is held between the first semi-inserted position and the second semi-inserted position, the front cover is moved from the opened position toward the normal position, FIG. 15A is a view of a case where the front cover is held to the opened position, FIG. 15B is a view subsequent to FIG. 15A, and showing a state where the front cover is moved from the opened position and guide edge portions of the first ribs are contacted with the box handle, FIG. 15C is a view subsequent to FIG. 15B, and showing a state where the second ribs are contacted with the rib housing recess, FIG. 15D is a view subsequent to FIG. 15C, and FIG. 15E is a view subsequent to FIG. 15D, and showing a state where the front cover is restricted by the box handle.

Referring to FIGS. 15A to 15E, in the case where the worker releases the grip in a semi-attached state of the waste toner box 31, the waste toner box 31 which is pushed by the box pushing member 13+14 is forward moved, and, depending on the amount of the waste toner recovered into the waste toner box 31 or the moment of the movement, may be moved to a position which is between the first semi-inserted position and the second semi-inserted position.

At this time, when, without noticing the semi-attached state, the worker moves the front cover U2*b* from the opened position to the normal position, the front end side of the rib housing recess 49*a* of the box handle 44 is contacted with the guiding edge portions 23*b* of the first ribs 23 as shown in FIG. 15B.

When the front cover U2*b* as it is moved toward the normal position, the box handle 44 is rearward pushed by the guiding edge portions 23*b* while being held to the waiting position, and the waste toner box 31 is moved to the second semi-inserted position. At the second semi-inserted position, the second ribs 24 are contacted with the inside of the rib housing recess 49*a* of the box handle 44. In the state where the box handle 44 is contacted with the second ribs 24, as shown in FIGS. 15C to 15E, the rotational movement of the front cover U2*b* to the normal position is restricted.

In an assumed configuration where the first ribs 23 and the second ribs 24 are formed as one rib and the rib is contacted with the waste toner box 31 which is moved between the first semi-inserted position and the second semi-inserted position, the rib is hardly engaged with the inside of the rib housing recess 49*a*, and there may arise a case where the rotational movement of the front cover U2*b* is not restricted. When the width the rib housing recess 49*a* in the front and rear directions is increased in accordance with this, the box handle 44 becomes bulky.

In another assumed configuration where another rib is disposed between the first ribs 23 and the second ribs 24 and the rib is contacted with the waste toner box 31 which is moved between the first semi-inserted position and the second semi-inserted position, the lengths of the ribs in the front and rear directions are shortened, and the ribs have low strength, so that the ribs are easily broken when the ribs are contacted with the box handle 44.

In Exemplary embodiment 1, by contrast, the guiding edge portions 23*b* are disposed in the first ribs 23, and the waste toner box 31 which has been moved between the first semi-inserted position and the second semi-inserted position is moved to the second semi-inserted position. Therefore, the box handle 44 is not bulky. In the state where the strengths of the ribs are ensured, even when the waste toner box 31 is moved between the first semi-inserted position and the second semi-inserted position, the rotational movement of the front cover U2*b* is restricted by the simple configuration of the contact of the members.

(Modifications)

Although the exemplary embodiment of the invention has been described in detail, the invention is not restricted to the exemplary embodiment. Various modifications are enabled within the scope of the spirit of the invention set forth in the claims. Modifications (H01) to (H014) of the invention will be exemplified.

(H01) Although, in the exemplary embodiment, the printer U has been described as an example of the image forming apparatus, the invention is not restricted to this. The image forming apparatus may be a copier, a facsimile apparatus, a multi-function apparatus having a plurality of functions of these apparatuses, or the like. The invention is not restricted to an image forming apparatus of the multi-color development system, and may be configured by a so-called monochromatic image forming apparatus.

(H02) Although, in the exemplary embodiment, the configuration due to the waste toner box 31 having the container main unit 32 has been exemplarily described as an example of the detachable body, the invention is not restricted to this. For example, the configuration of the invention may be applied to a case where a detachable body such as the toner cartridges Ky to Kk and a process unit which is an example of the visible-image forming device unit, or a detachable body such as an intermediate transferring device is inserted or extracted to be attached or detached to or from the image forming apparatus main unit U2.

Therefore, the configuration of the invention is not restricted to an electrophotographic image forming apparatus, and may be applied to an arbitrary image forming apparatus having a detachable body main unit which is attached and detached by insertion and extraction, such as a printing machine of the inkjet recording system, the thermal head system, or the lithography system.

(H03) In the exemplary embodiment, preferably, the box pushing member 13+14 is disposed. Alternatively, the box pushing member 13+14 may be omitted.

(H04) In the exemplary embodiment, preferably, the rib housing recess 49*a* that is an example of the restricting portion with which the first ribs 23 and the second ribs 24 are contacted is disposed in the box handle 44 which is to be gripped by the worker. The invention is not restricted to this. Depending on the configuration, the recess may be disposed in an arbitrary member as far as the member is disposed downstream from the detachable body main unit in the detachable body main unit drawing direction.

(H05) In the exemplary embodiment, the configuration formed by the rib housing recess 49*a*, the first ribs 23, and the second ribs 24 has been exemplarily described as the configuration of the restricting portion and the restricted portion. The invention is not restricted to this. For example, a configuration may be possible where a recess is disposed as the restricted portion in the front cover U2*b*, a restricting portion corresponding to the recess is formed in the box handle 44, and the box handle 44 is hooked by the recess, thereby restricting the rotational movement of the front cover U2*b* to the normal position.

(H06) In the exemplary embodiment, preferably, the hinge shaft 22*a* of the front cover U2*b*, and the handle shaft 44*a* of the box handle 44 are extended in the right and left directions. The invention is not restricted to this. A configuration where the shafts are vertically extended may be possible.

(H07) In the exemplary embodiment, preferably, the box handle 44 is rotated about the rotation center which coincides with the extension direction of the hinge shaft 22*a*. Alternatively, a configuration may be possible where the box handle 44 is rotated about the rotation center which is different from the extension direction of the hinge shaft 22*a*.

(H08) Although, in the exemplary embodiment, the configuration where the box handle 44 is rotated about the handle shaft 44*a* has been exemplarily described, the invention is not restricted to this. For example, a configuration where the box handle 44 is not rotated, such as that where the box handle 44 is elastically deformed and swung in a state where the box handle 44 is fixed in a basal end portion may be possible.

(H09) In the exemplary embodiment, preferably, the guiding edge portions 23*b* are formed in the first ribs 23. Alternatively, the guiding edge portions may be omitted.

(H010) Although, in the exemplary embodiment, the configuration where the first ribs 23 and the second ribs 24 are formed has been exemplarily described, only one rib or three or more ribs may be disposed depending on the configuration.

(H011) In the exemplary embodiment, preferably, the box pushing member 13+14 has the box contacting member 13. Alternatively, the box contacting member 13 may be omitted.

(H012) In the exemplary embodiment, the configuration is preferable where the box pushing member 13+14 is moved in the detachable body main unit drawing direction, and the pushing coil spring 14 urges along the detachable body main unit drawing direction. The invention is not restricted to this. For example, configurations where the box pushing member 13+14 is moved in a direction inclined to the detachable body main unit drawing direction, and where the pushing coil spring 14 urges the detachable body main unit along a direction inclined to the detachable body main unit drawing direction may be possible.

(H013) In the exemplary embodiment, preferably, the latch contacting portion 42*a* and the pushing member receiving portion 42*d* are disposed in the container projected portion 42. The invention is not restricted to this. For example, a configuration may be possible where the pushing member receiving portion 42*d* which is contacted with the box pushing member 13+14 is disposed in the rear end of the container main unit 32 that is separated from the container projected portion 42, and contacted with the box pushing member 13+14 to be pushed out.

(H014) In the exemplary embodiment, preferably, the latch 19 is moved in a direction perpendicular to the detachable body main unit drawing direction. Alternatively, a configuration where the latch is moved in a direction which is not perpendicular to the detachable body main unit drawing direction may be possible.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

an image forming apparatus main unit;

an opening that is formed in an outer face of the image forming apparatus main unit;

an attached/detached portion that is formed inside the image forming apparatus main unit, and that is connected to the opening;

an opening/closing member that is supported by a support shaft, and that is supported to be rotatable between an opened position where the opening is exposed to an outside and a normal position where the opening is closed from the outside, in which a restricted portion is disposed in a face on a side of the image forming apparatus main unit, the restricted portion comprising a projecting portion;

a detachable body main unit that is attached and detached by being inserted and extracted between an attached position where the unit is attached to the attached/detached portion and a separated position where the unit is drawn out from the attached/detached portion to an outside of the image forming apparatus main unit; and a restricting portion that is disposed downstream in a detachable body main unit drawing direction that is directed from the attached position of the detachable body main unit to the separated position, and that is contactable with the restricted portion, the restricting portion comprising a recess configured to receive the projecting portion, wherein, in a case where the opening/closing member is rotationally moved from the opened position toward the normal position, when the detachable body main unit is at a restricted position that is between the attached position and the separated position, the restricting portion is contacted with the restricted portion so as to be moved into a position between the opening/closing member and the detachable body main unit, so as to restrict a rotational movement of the opening/closing member toward the normal position, and, when the detachable body main unit is at the attached position, the restricting portion and the restricted portion that is being rotated are separated from each other to enable the opening/closing member to be rotationally moved to the normal position, and, in a case where the opening/closing member is moved to the normal position, the restricted portion is housed in a space between the detachable body main unit and the opening/closing member.

2. The image forming apparatus according to claim 1, wherein the apparatus further comprises a gripping portion that is supported by a downstream side of the detachable body main unit in the detachable body main unit drawing direction, and that has the restricting portion, wherein in a case where, when the opening/closing member is rotationally moved from the opened position toward the normal position, the detachable body main unit is at the restricted position that is between the attached position and the separated position, the restricting portion is contacted with the restricted portion to restrict a rotational movement of the opening/closing member toward the normal position, and, in a case where the detachable body main unit is at the attached position, the restricting portion and the restricted portion that is being rotated are separated from each other to enable the opening/closing member to be rotationally moved to the normal position, and, when the opening/closing member is moved to the normal position, the restricted portion is housed in a space between the gripping portion and the opening/closing member.

3. The image forming apparatus according to claim 2, wherein the restricted portion is projected toward the image forming apparatus main unit, and the gripping portion is configured so that a basal end portion is supported to be rotatable about a rotation center which is extended in a direction substantially parallel to a support shaft of the opening/closing member, the restricting portion with which the restricted portion is contacted to be hookable is formed in a tip end portion, the gripping portion is rotatable between a waiting position which is along a detachable body main unit downstream end face that is an outer face of the detachable body main unit, and that is downstream in the detachable body main unit drawing direction, and a drawn position which is rotated about the rotation center with respect to the detachable body main unit downstream end face, and, in a case where the detachable body main unit is moved to the restricted position and the opening/closing member is rotationally moved from the opened position to the normal position, the restricting portion is hooked with the restricted portion of the opening/closing member, and the gripping portion is moved from the waiting position to the drawn position, thereby restricting rotation of the opening/closing member.

4. The image forming apparatus according to claim 3, wherein the restricted portion has: a first restricted portion in which a guiding portion that is contactable with the restricting portion is formed in an end portion on a side of the support shaft of the opening/closing member, and which is projected toward the image forming apparatus main unit; and a second restricted portion which is disposed on the side of the support shaft of the opening/closing member with respect to the first restricted portion, and which is projected toward the image forming apparatus main unit, and the gripping portion, which has the restricting portion, and which is supported by the downstream side of the detachable body main unit in the detachable body main unit drawing direction, is configured so that, in a case where the detachable body main unit is moved to the attached position and the opening/closing member is moved to the normal position, a restricted portion housing space in which the first restricted portion and the second restricted portion are to be housed is formed between the gripping portion and the opening/closing member, and, in a case where the detachable body main unit is moved to a first restricted position which is between the attached position and the separated position, the restricting portion is contacted with the first restricted portion of the opening/closing member which is moved from the opened position to the normal position, thereby restricting rotation of the opening/closing member, and, in a case where the detachable body main unit is moved to a second restricted position which is between the attached position and the first restricted position, the restricting portion is contacted with the second restricted portion of the opening/closing member which is moved from the opened position to the normal position, thereby restricting rotation of the opening/closing member, and, in a case where the detachable body main unit is moved to a position between the first restricted portion and the second restricted position, the restricting portion is contacted with the guiding portion of the first restricted portion of the opening/closing member which is moved from the opened position to the normal position, thereby causing the detachable body main unit to be moved to the second restricted position.

5. The image forming apparatus according to claim 1, wherein the apparatus further comprises a gripping portion that has the restricting portion, and that is supported by a downstream side of the detachable body main unit in the detachable body main unit drawing direction, and, in a case where the detachable body main unit is moved to the attached position and the opening/closing member is moved to the normal position, a restricted portion housing space in which the restricted portion is to be housed is formed between the gripping portion and the opening/closing member, and, in a case where the detachable body main unit is moved to the restricted position that is between the attached position and the separated position, the restricting portion is contacted with the restricted portion of the opening/closing member that is moved from the opened position to the normal position, so as to restrict rotation of the opening/closing member.

6. The image forming apparatus according to claim 1, wherein the apparatus further comprises an image recording apparatus which records an image formed by a developer, onto a medium, and the detachable body main unit recovers the developer from the image recording apparatus.

7. A detachable body comprising:

a detachable body main unit that is attached and detached by being inserted and extracted between an attached position where the detachable body main unit is attached to an attached/detached portion connected to an opening that is formed in an outer face of an image forming apparatus main unit, and that is formed inside the image forming apparatus main unit, and a separated position where the detachable body main unit is drawn out from the attached/detached portion to an outside of the image forming apparatus main unit; and a restricting portion that is disposed downstream in a detachable body main unit drawing direction that is directed from the attached position of the detachable body main unit to the separated position, and that is contactable with a restricted portion, the restricted portion comprising a projecting portion, and the restricting portion comprising a recess configured to receive the projecting portion, wherein, in a case where an opening/closing member, which is rotatably supported by a support shaft of the opening/closing member, and in which the restricted portion is disposed in a face on a side of the image forming apparatus main unit, is rotationally moved from an opened position, where the opening is exposed to an outside, to a normal position, where the opening is closed from the outside, when the detachable body main unit is at a restriction position which is between the attached position and the separated position, the restricting portion is contacted with the restricted portion, thereby restricting rotational movement of the opening/closing member to the normal position, and, when the detachable body main unit is at the attached position, the restricting portion and the restricted portion which is being rotated are separated from each other to enable the opening/closing member to be rotationally moved to the normal position, and, in a case where the opening/closing member is moved to the normal position, the restricted portion is housed in a space between the detachable body main unit and the opening/closing member.

8. An image forming apparatus comprising:

an image forming apparatus main unit;

an opening that is formed in an outer face of the image forming apparatus main unit;

an attached/detached portion that is formed inside the image forming apparatus main unit, and that is connected to the opening;

an opening/closing member that is supported by a support shaft, and that is supported to be rotatable between an opened position where the opening is exposed to an outside and a normal position where the opening is closed from the outside, in which a restricted portion is disposed in a face on a side of the image forming apparatus main unit;

a detachable body main unit that is attached and detached by being inserted and extracted between an attached position where the unit is attached to the attached/detached portion and a separated position where the unit is drawn out from the attached/detached portion to an outside of the image forming apparatus main unit;

a restricting portion that is disposed downstream in a detachable body main unit drawing direction that is directed from the attached position of the detachable body main unit to the separated position, and that is contactable with the restricted portion; and a gripping portion that is supported by a downstream side of the detachable body main unit in the detachable body main unit drawing direction, and that has the restricting portion, wherein, in a case where the opening/closing member is rotationally moved from the opened position toward the normal position, when the detachable body main unit is at a restricted position that is between the attached position and the separated position, the restricting portion is contacted with the restricted portion so as to be moved into a position between the opening/closing member and the detachable body main unit, so as to restrict a rotational movement of the opening/closing member toward the normal position, and, when the detachable body main unit is at the attached position, the restricting portion and the restricted portion that is being rotated are separated from each other to enable the opening/closing member to be rotationally moved to the normal position, and, in a case where the opening/closing member is moved to the normal position, the restricted portion is housed in a space between the detachable body main unit and the opening/closing member and between the gripping portion and the opening/closing member, wherein the restricted portion is projected toward the image forming apparatus main unit, and wherein the gripping portion is configured so that the restricting portion with which the restricted portion is contacted to be hookable is formed in a tip end portion, and in a case where the detachable body main unit is moved to the restricted position and the opening/closing member is rotationally moved from the opened position to the normal position, the restricting portion is hooked with the restricted portion of the opening/closing member, and the gripping portion is moved from a waiting position to a drawn position, thereby restricting rotation of the opening/closing member.

9. The image forming apparatus according to claim 8, wherein, in a case where the detachable body main unit is moved to the attached position and the opening/closing member is moved to the normal position, a restricted portion housing space in which the restricted portion is to be housed is formed between the gripping portion and the opening/closing member, and, in a case where the detachable body main unit is moved to the restricted position that is between the attached position and the separated position, the restricting portion is contacted with the restricted portion of the opening/closing member that is moved from the opened position to the normal position, so as to restrict rotation of the opening/closing member.

10. The image forming apparatus according to claim 8, wherein the restricted portion has: a first restricted portion in which a guiding portion that is contactable with the restricting portion is formed in an end portion on a side of the support shaft of the opening/closing member, and which is projected toward the image forming apparatus main unit; and a second restricted portion which is disposed on the side of the support shaft of the opening/closing member with respect to the first restricted portion, and which is projected toward the image forming apparatus main unit, and the gripping portion, which has the restricting portion, and which is supported by the downstream side of the detachable body main unit in the detachable body main unit drawing direction, is configured so that, in a case where the detachable body main unit is moved to the attached position and the opening/closing member is moved to the normal position, a restricted portion housing space in which the first restricted portion and the second restricted portion are to be housed is formed between the gripping portion and the opening/closing member, and, in a case where the detachable body main unit is moved to a first restricted position which is between the attached position and the separated position, the restricting portion is contacted with the first restricted portion of the opening/closing member which is moved from the opened position to the normal position, thereby restricting rotation of the opening/closing member, and, in a case where the detachable body main unit is moved to a second restricted position which is between the attached position and the first restricted position, the restricting portion is contacted with the second restricted portion of the opening/closing member which is moved from the opened position to the normal position, thereby restricting rotation of the opening/closing member, and, in a case where the detachable body main unit is moved to a position between the first restricted portion and the second restricted position, the restricting portion is contacted with the guiding portion of the first restricted portion of the opening/closing member which is moved from the opened position to the normal position, thereby causing the detachable body main unit to be moved to the second restricted position.

11. The image forming apparatus according to claim 8, wherein the apparatus further comprises an image recording apparatus which records an image formed by a developer, onto a medium, and the detachable body main unit recovers the developer from the image recording apparatus.

* * * * *